US012747578B2

(12) United States Patent
Gilbert

(10) Patent No.: US 12,747,578 B2
(45) **Date of Patent: *Sep. 29, 2026**

(54) STORAGE SHED

(71) Applicant: Suncast Technologies, LLC, Palm Beach Gardens, FL (US)

(72) Inventor: Richard Gilbert, Southfield, MI (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 162 days.

This patent is subject to a terminal disclaimer.

(21) Appl. No.: 18/368,736

(22) Filed: Sep. 15, 2023

(65) Prior Publication Data

US 2025/0092665 A1 Mar. 20, 2025

(51) Int. Cl.

| | |
|---|---|
| ***E04B 1/343*** | (2006.01) |
| ***E04B 1/61*** | (2006.01) |
| ***E04H 1/12*** | (2006.01) |

(52) U.S. Cl.

CPC ..... *E04B 1/34321* (2013.01); *E04B 1/6116* (2013.01); *E04H 1/1205* (2013.01); *E04B 2103/04* (2013.01)

(58) Field of Classification Search

CPC ..... E04B 1/34321; E04B 1/6116; E04B 2103/04; E04B 2/7425; E04B 2/766; E04H 1/1205; Y10T 403/725

USPC ..... 52/91.1, 91.3, 106, 165, 169.13, 170, 52/282.1

See application file for complete search history.

(56) References Cited

U.S. PATENT DOCUMENTS 4,557,091 A * 12/1985 Auer ..... E04C 2/40 52/592.4
5,036,634 A * 8/1991 Lessard ..... E04H 1/1205 D25/16
5,157,882 A * 10/1992 Soble ..... E04H 12/2269 52/165
5,697,190 A * 12/1997 Scribner ..... E04H 12/2261 52/165
6,591,558 B1 * 7/2003 De Zen ..... E04C 2/20 52/91.1

(Continued)

FOREIGN PATENT DOCUMENTS

AT 524010 A2 1/2022
AT 524010 A3 7/2022

(Continued)

*Primary Examiner* — Brian E Glessner
*Assistant Examiner* — Adam G Barlow
(74) *Attorney, Agent, or Firm* — McHale & Slavin.com

(57) ABSTRACT

A storage shed including one or more extruded wall uprights, one or more blow-molded wall panels, one or more extruded corner uprights including a first corner upright a second corner upright, a blow-molded first door jamb panel, and a blow-molded second door-jamb panel. Some of the extruded corner uprights, some of the one or more extruded wall uprights, and some of the one or more blow-molded wall panels are collectively configured to, when assembled, directly attach to one another to form a sidewall or a rear wall of the storage shed. The blow-molded first door-jamb panel is configured to directly attach to the first corner upright and the blow-molded second door-jamb panel, spaced apart from the first door-jamb panel, and configured to directly attach to the second corner upright.

6 Claims, 21 Drawing Sheets

(56) References Cited

U.S. PATENT DOCUMENTS 6,889,475 B2 * 5/2005 De Zen ..... E04C 2/20 52/91.1
7,581,357 B2 * 9/2009 Richardson ..... E04B 1/34321 52/79.5
7,707,783 B2 5/2010 Mower et al.
7,779,579 B2 * 8/2010 Mower ..... E04B 1/34321 52/79.5
7,797,885 B2 * 9/2010 Mower ..... E04H 1/1205 52/270
7,877,936 B2 * 2/2011 Uffner ..... E04B 7/20 52/79.5
7,926,227 B2 * 4/2011 Mower ..... E04B 1/34321 52/270
8,020,347 B2 9/2011 Mower et al.
8,342,107 B2 1/2013 Mower et al.
8,827,763 B2 * 9/2014 DeBlanco ..... A63H 33/008 446/478
11,078,678 B2 * 8/2021 Eilers ..... E04H 1/1205
11,147,365 B2 10/2021 Jones et al.
11,266,230 B2 3/2022 Jones et al.
11,395,541 B2 7/2022 Jones et al.
2004/0049992 A1 * 3/2004 Seavy ..... E04B 2/7453 52/302.5
2004/0074158 A1 * 4/2004 De Zen ..... E04B 1/12 52/79.9
2004/0187400 A1 * 9/2004 Anderson ..... E04B 1/34321 52/79.1
2006/0108899 A1 * 5/2006 Jin ..... A47B 43/00 312/107
2006/0277852 A1 * 12/2006 Mower ..... E04H 1/1205 52/270
2007/0175108 A1 * 8/2007 Stein ..... E04B 1/34321 52/79.5
2007/0209295 A1 * 9/2007 Mower ..... E04B 1/34321 52/79.1
2011/0308433 A1 12/2011 Strong et al.
2014/0182219 A1 * 7/2014 Thuma ..... E04B 1/34321 52/79.5
2016/0083955 A1 * 3/2016 Fekete ..... E04H 1/1205 52/264
2016/0138258 A1 * 5/2016 Schaffert ..... E04B 1/3445 52/79.5
2020/0245755 A1 8/2020 Jones et al.
2020/0245757 A1 8/2020 Jones et al.
2020/0318406 A1 10/2020 Branch et al.
2021/0137261 A1 5/2021 Jones et al.
2022/0160122 A1 5/2022 Jones et al.
2024/0309632 A1 * 9/2024 Schofield ..... E04B 1/6116

FOREIGN PATENT DOCUMENTS

CA 3077886 A1 10/2020
CA 3077886 C 7/2022
CN 111801215 A 10/2020
CN 113631788 A 11/2021
CN 111801215 B 2/2023
CN 116080045 A 5/2023
CN 113631788 B 6/2023
GB 2596743 A 1/2022
GB 2596743 B 8/2023
TW 202037477 A 10/2020
WO 2020160523 A1 8/2020
WO 2020205956 A1 10/2020

* cited by examiner

STORAGE SHED

TECHNICAL FIELD

The present disclosure relates to a storage shed for outdoor use. More specifically, this disclosure relates to a storage shed with a bottom panel, a number of side panels and upright members that slide into engagement with one another for easy assembly.

BACKGROUND

Outdoor storage sheds for stowing outdoor equipment such as lawn implements, tools, furniture, toys, etc. are known in the art. Outdoor storage sheds may be formed of plastic and must have the ability to be resistant to the elements (rain, snow, wind, etc.). Assembly of these sheds can be troublesome due to the amount of external hardware required, such as screws, nuts, bolts, etc. These hardware pieces can be lost during assembly or can become dislodged from the shed over time, which can lead to structural deficiencies and degradation of the shed's structure.

SUMMARY

According to at least one embodiment, a storage shed is provided. The storage shed may include one or more extruded wall uprights, one or more blow-molded wall panels, one or more extruded corner uprights, a blow-molded first door-jamb panel, and a blow-molded second door-jamb panel. The one or more extruded corner uprights includes a first corner upright and a second corner upright. The first corner upright, some of the one or more extruded wall uprights, and some of the one or more blow-molded wall panels may be collectively configured to attach to one another to form a sidewall or a rear wall of the storage shed. The blow-molded first door-jamb panel may be configured for attachment to the first corner upright and the blow-molded second door-jamb panel may be spaced apart from the first door-jamb panel and configured for attachment the second corner upright.

According to another embodiment, a storage shed including a blow-molded floor panel, one or more uprights, a first blow-molded side panel, and a second blow-molded side panel, is provided. The blow-molded floor panel may be configured to form a floor of the storage shed and the number of uprights may be configured to be fixed directly to the blow-molded floor panel. The number of uprights may include a wall upright. The wall upright may be disposed between the first blow-molded side panel and the second blow-molded side panel so that the first and second blow-molded panels are fixed to one another to form at least a portion of a wall of the storage shed.

According to another embodiment, a method of assembling a storage shed is provided. The method may include: Attaching a number of blow-molded floor panels to one another to form a floor of the storage shed; Inserting a number of wall anchors through a number of anchor aperture defined by the floor, the number of wall anchors each including a post; Attaching an extruded corner upright to a first wall anchor of the number of wall anchors disposed in a corner region of the floor; Attaching a first extruded wall upright of the number of wall uprights to a second wall anchor of the number of wall anchors, the second wall anchor spaced apart from the first wall anchor; and Attaching, by at least one form-fit condition, a blow-molded first wall panel to the corner upright and the first extruded wall upright.

DETAILED DESCRIPTION

Figure 1:
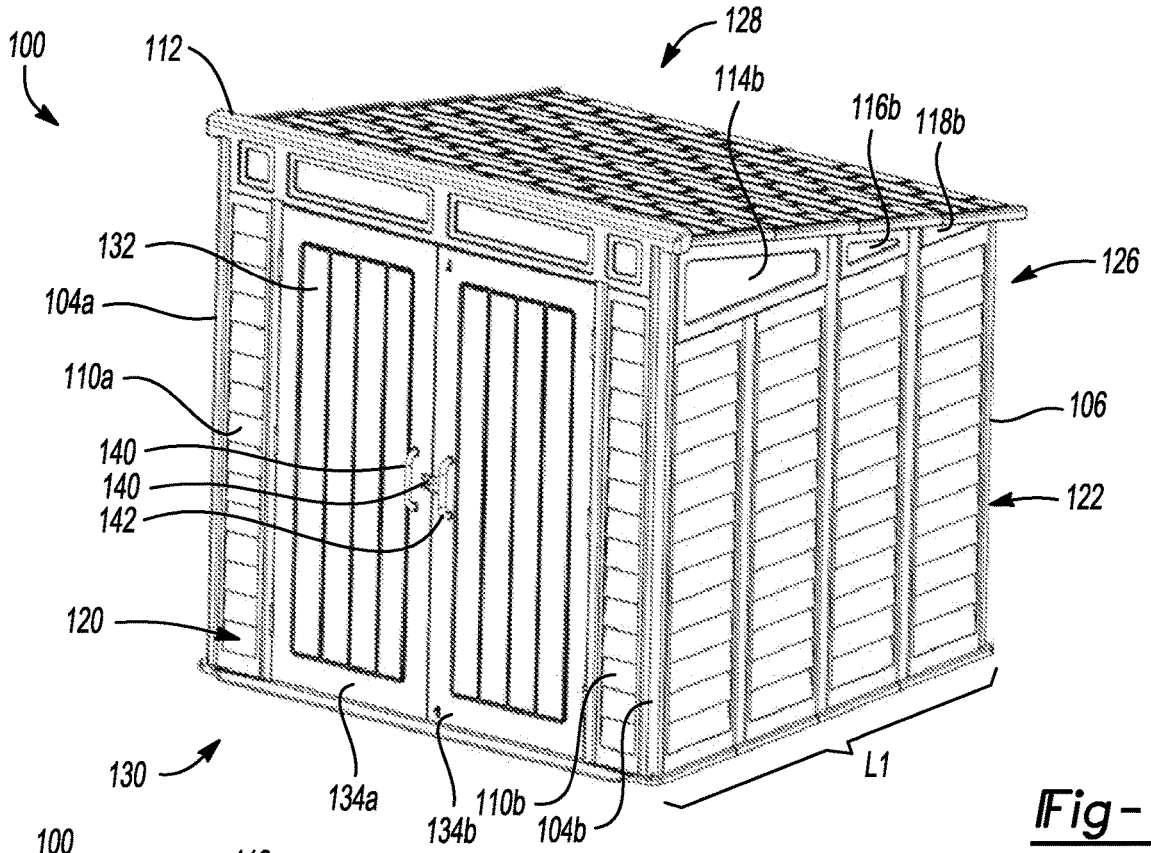
FIG. 1 illustrates a front-perspective view of an exemplary storage shed.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

The use of directional terms herein are meant to be relative to the orientation shown in the Figures to give context to the interplay and relative location of various regions or parts of the storage shed. Such terms include "side," "top," "bottom," "front," "back," etc. These terms are meant to give context to the relative location of indicated parts of the shed relative to other parts of the shed as shown in the orientation depicted in the Figures, and are not meant to be limiting on the scope of the shed in any other fashion unless specifically indicated.

As used in the specification and the appended claims, the singular form "a," "an," and "the" comprise plural referents unless the context clearly indicates otherwise. For example, reference to a component in the singular is intended to comprise a plurality of components.

The term "substantially" or "about" may be used herein to describe disclosed or claimed embodiments. The term "substantially" or "about" may modify a value or relative characteristic disclosed or claimed in the present disclosure. In such instances, "substantially" or "about" may signify that the value or relative characteristic it modifies is within ±0%, 0.1%, 0.5%, 1%, 2%, 3%, 4%, 5% or 10% of the value or relative characteristic.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. However, it should be understood that two constituent or major components that are securely fixed to one another at a joint or other interface, may be considered directly connected even in cases where one or intermediary components (e.g., washers, bushing, gaskets covers) are disposed between the constituent components to facilitate the secured attachment of the same. Other words used to describe the relationship between elements should be interpreted in a like fashion (e.g., "between" versus "directly between," "adjacent" versus "directly adjacent," etc.). The term "and/or" may include any and all combinations of one or more of the associated listed items.

Although the terms first, second, third, etc. may be used to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Known sheds typically include several components such as wall panels, floor panels, roof panels, doors that must be assembled to form portions or sub-assemblies that are fixed to one another. Those portions and sub-assemblies must be assembled to one another to form the overall shed assembly. In order to facilitate shipping or transporting of the shed between a manufacturer and a retailer and between the retailer and a consumer, the sub-assemblies or portions need to be in a disassembled state and assembled at the desired location. The portions and sub-assemblies are generally formed of individual components that are fixed to one another by several fasteners (e.g., screws, bolts, nuts, rivets) and bracketry.

Depending on the amount strength or rigidity required, intermediary brackets may be required to provide a suitable cross-sectional area to provide sufficient clamping force between individual components and/or the sub-assemblies to form a suitable fastening joint. Moreover, several fastening joints that are spaced a part from one another may be required to connect two components or two sub-assemblies to one another. The use of fasteners, such as self-tapping screws, bolts and nuts, or other threaded fasteners, inherently requires employment of at least one additional component (e.g., the fastener and/or nut) for each fastening joint as compared to a fastener-less attachment or connection.

Known sheds may be reinforced by elongated metal (e.g., steel) members such as rods, or beams fixed to portions of the shed, such as the walls and roof. These reinforcements may be fixed to the walls and roof members by several fasteners and the reinforcements generally extend along the entire length of the component being reinforced (e.g., extending in a vertical direction along the entire wall or in the lateral and longitudinal direction along the roof members). Such reinforcements may be formed by one or more stamping or casting processes.

Some known sheds may include plastic components (e.g., wall panels, roof members, and floor panels) formed by injection molding. Injection molding plastics generally includes feeding materials (e.g., elastomers, thermoplastic, thermosetting polymers) into a heated barrel, mixed (e.g., by a helical screw) and injected into a mold cavity, in which the melted material cools and hardens to form the shape of the cavity. Due to inherent limitations of injection molding, components formed by injection molding generally have a solid body or cross-section. Accordingly, forming hollow-bodied components by injection molding is not possible or feasible.

Referring generally to the figures, one or more storage sheds are shown and described herein. The storage shed 100 includes wall uprights 102, corner uprights 104, 106, wall panels 108, and first and second door-jamb panels 110*a*, 110*b*. As described herein, the wall panels 108 and/or the door-jamb panels 110*a*, 110*b* are connectable to one another by a press fit, allowing a user to assemble the wall panels 108, the door-jamb panels 110*a*, 110*b*, or both, to the wall uprights 102 and the corner uprights 104, 106, without the use of fasteners (e.g., bolts, nuts, screws).

The assembled storage shed 100 provides an auxiliary storage area often placed outside a user's home. The structure of the wall panels 108, door-jamb panels 110, wall and corner uprights 102-106 and the engagement between the panels 108-110 and the uprights 102-106, given the teachings herein, provide the storage shed 100 with the ability to be resistant to the elements (rain, snow, wind, etc.) while safely storing outdoor equipment such as lawn implements, tools, furniture, toys, etc. in a rigid, easy-to-assemble container. As one example, the panels 108-110 may be connected to the uprights 102-106 by sliding the panels 108-110 into the uprights 108-110 to form walls 120-126 of the storage shed 100.

The walls 120-126 of the storage shed 100 include the front wall 120, first sidewall 122, second sidewall 124, and a rear wall 126. The front wall 120 includes at least one door-jamb wall, such as the first door-jamb wall 110*a* and the second door-jamb wall 110*b*, and a header 112 each of which may be connected to front corner uprights 104. The first and second sidewalls 120, 122 and the rear wall 124 each include one or more of the wall panels 108 that are connected to rear corner uprights 106 and the wall uprights 102. As an example, a first wall panel 108 of one of the sidewalls 122, 124 positioned nearest to the front wall 120 is disposed between a front corner upright 104 and a first upright of one of the uprights 102 and another or second wall panel 108, disposed adjacent to the first wall panel 108 is disposed between first upright 102 and a second upright 102. The spacing between corner uprights 104, 106 and adjacent wall uprights 102, as well as the spacing between adjacent wall uprights may be substantially the same which enables each of the wall panels 108 to have a substantially consistent width.

In one or more embodiments, the door-jamb wall panels 110*a*, 110*b*, wall panels 108, and header 112 are made of a polymeric material (e.g., polyethylene) that is blow-molded to shape. Blow molding of the panels and header 108-112 enables the panels and header to be hollow, lightweight, and sufficiently rigid prior to (e.g., during transit) and after assembly. What is more, because the hollow construction of the blow-molded panels and header 108-112 make them relatively lighter as compared to configurations produced by other manufacturing methods (e.g., injection molding), positioning the panels and header during assembly is relatively easier and less burdensome than other configurations. It should be understood that one or more of the panels and header 108-112 may be formed by another process such as injection molding.

The storage shed 100 includes a roof assembly 128 disposed above the walls 120-126 and a floor assembly 130 disposed below the walls. In at least one embodiment, the roof assembly 128 may be pitched or slanted from the front wall 120 towards the rear wall 126, though other configurations are readily contemplated herein. The roof assembly 128 may be supported by one or more roofline panels, including a front roofline panels 114*a*, 114*b*, middle roofline panels 116*a*, 116*b*, and rear roofline panels 118*a*, 118*b*. The roofline panels 114-118 may be disposed between the roof assembly 128 and the wall panels 108 and uprights 102 and each of the roofline panels 114-118 may be tapered from the front of the shed 100 towards the rear of the shed 100. Because the roofline panels 114-118 collectively taper from front to rear, so that a rear portion of the roofline panels are narrower than the front portion of roofline panels and the wall panels 108 which form the sidewalls 122, 124 and rear wall 126 have a substantially consistent height. Because the wall panels 108 have a common height and width, the wall panels are interchangeable. This interchangeability reduces part and assembly complexity; use of unique tools (e.g., dies, molds, blow molding machinery) required to produce panels that differ in size and shape is avoided, and a user need not be concerned with sorting and placing unique panels in their required position during assembly.

According to one or more embodiments, the uprights 102-106 include an elongated body formed by an extruded alloy (e.g., extruded aluminum) provided with grooves or slots 148 extending along the sides of the uprights 102-106. The use of extruded aluminum to form the uprights 102-106 may reduce the weight of the shed 100 as compared to uprights formed by of other heavier materials (e.g., steel).

The slots 148 of the wall uprights 102-106 may be formed by flanges 150 extending from one or more medial walls 152 which form a receptacle 154 extending along one or portions of the wall uprights 102. As an example, the flanges 150 forming the slots may be parallel with respect to one another and perpendicular to the medial walls 152 so that the slots 148 oppose one another and are substantially aligned with one another. Each of the wall panels 108 include a first edge portion 156 and a second edge portion 158 that each extend from a main portion 160 of the wall panel 108. The edge portions each include a tongue 162 that is slid or pressed into the slots 148 of each of the wall uprights 102.

The slots 148 of the corner uprights 104, 106 may be formed by flanges 164 extending from one or more medial walls 166 which form a receptacle 168 extending along one or more portions of the corner uprights 104, 106. As will be described in greater detail below, the receptacle 154 of the wall upright 102 and the receptacle of the corner uprights 104, 106 receive at least a portion of the wall anchor 138 to fix the uprights 102-106 to the floor assembly 130 by pressing one or more of the uprights 102-106 onto or into one or more portions of the wall anchor 138. The flanges 164 may include a first flange 164*a* and a second flange 164*b* that are arranged substantially orthogonal to one another.

Figure 2:
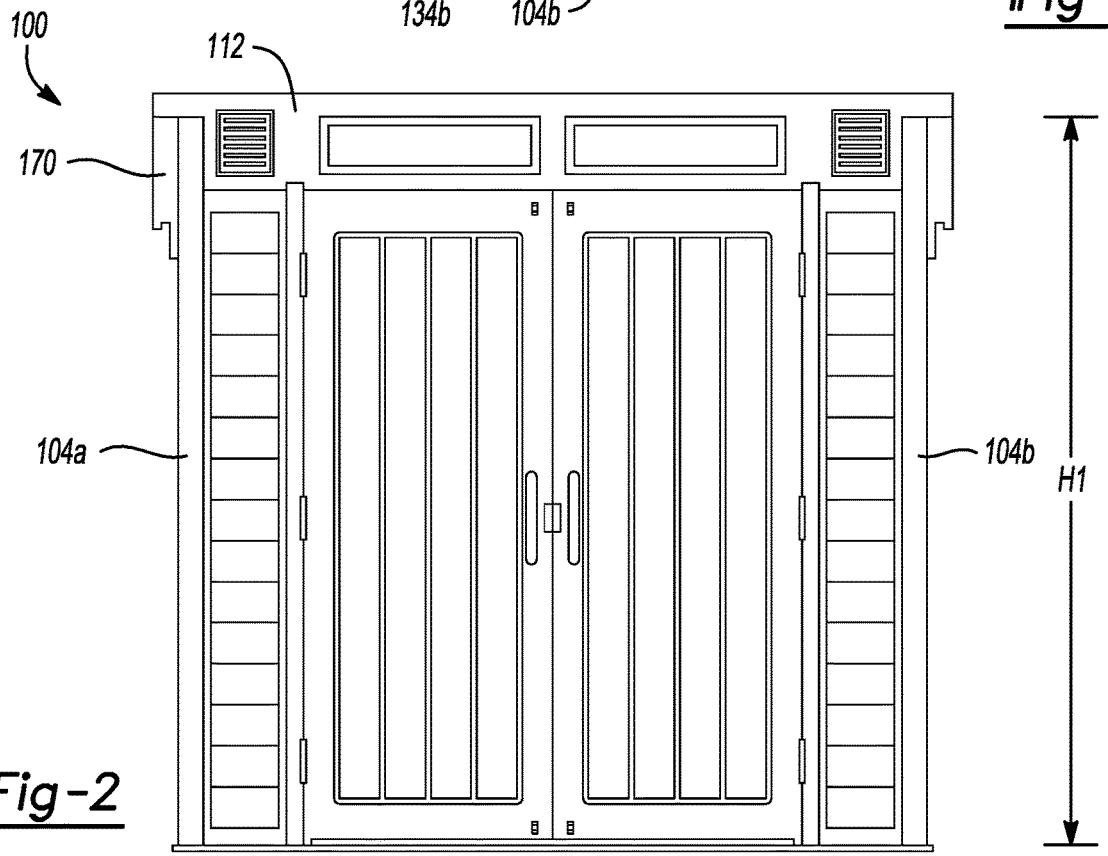
FIG. 2 illustrates a front-plan view of the exemplary storage shed illustrated in FIG. 1.
Figure 15:
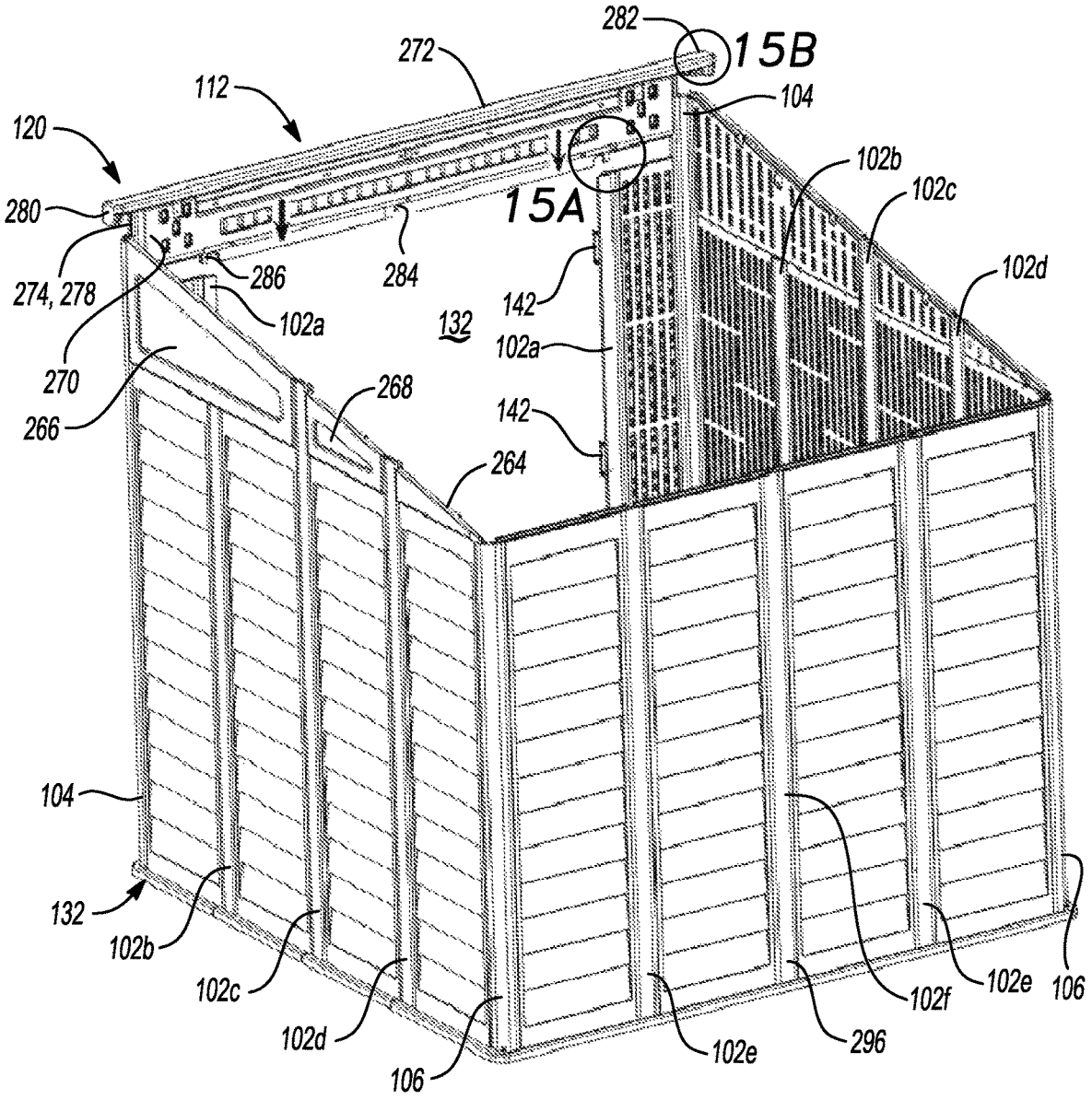
FIG. 15 illustrates a rear-perspective view of a partial assembly of the shed assembly shown in FIG. 1.

FIG. 1 and FIG. 2 each show the storage shed 100. The storage shed 100 includes a floor assembly 130 that supports and fixes the position of the front wall 130, rear wall 126, and sidewalls 122, 124. The front wall 130 includes first door-jamb panel 110*a*, the second door-jamb panel 110*b*, and the header 112 that are collectively supported by the front corner uprights 104. The first and second door-jamb panels are spaced apart to define a door opening 132 (FIG. 15). In one embodiment, the first and second doors 134*a*, 134*b* are rotationally coupled to the first and second door-jamb panels 110, 110*b* (e.g., by hinges 142) so that the doors 134 may close the opening 132 when in the closed position and provide access to the interior of the shed when the doors 134*a*, 134*b* are open. As the doors 134 are opened and closed, the user may grasp door handles 140 fixed to each of the doors 134*a*, 134*b* and the user may lock the doors 134 by use of a latch or lock assembly 144.

The roof assembly 128 and the header 112 collectively form an overhang 170 that extend beyond an outer periphery of one or more of the walls 120-126. The overhang 170 extends along the first sidewall 122, the second sidewall 124, and the rear wall 126. It should be understood that the overhang 170 may also extend beyond the front wall 120 of the storage shed. The overhang may divert water away from the walls 120-126 to prevent or mitigate water from entering the interior of the storage shed 100. In one or more embodiments, the blow-molded header 112 includes one or more vents 171 to enable air flow between the interior and exterior of the storage shed 100.

Figure 3:
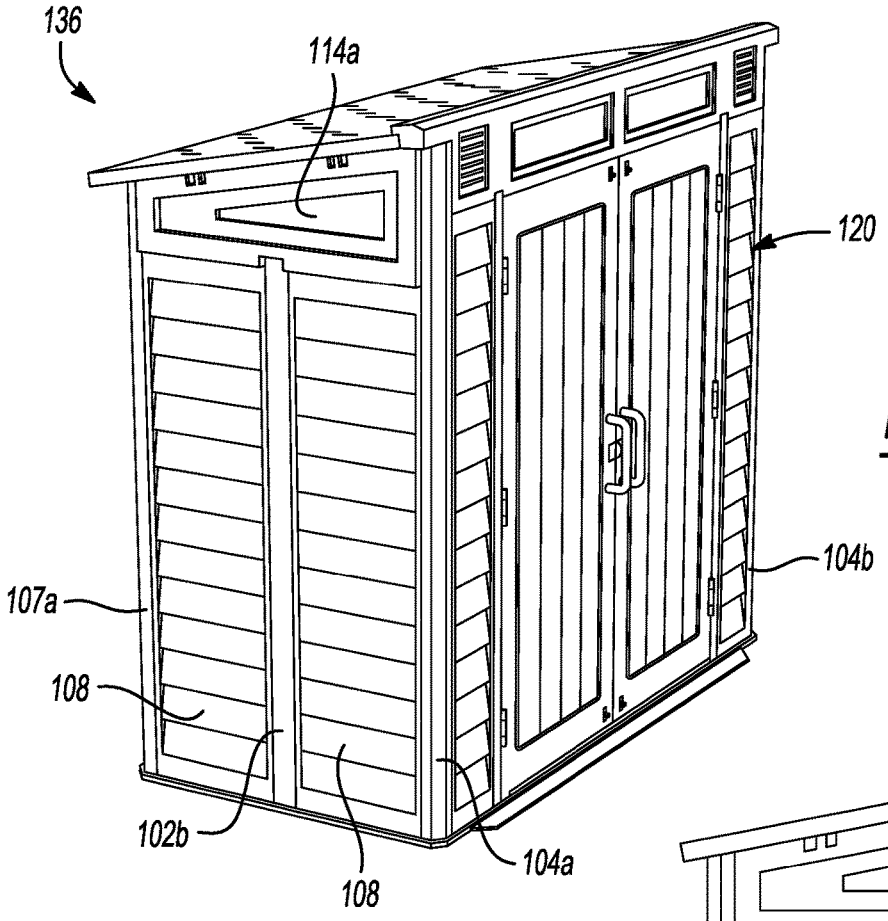
FIG. 3 illustrates a front-perspective view of an exemplary storage shed.
Figure 3A:
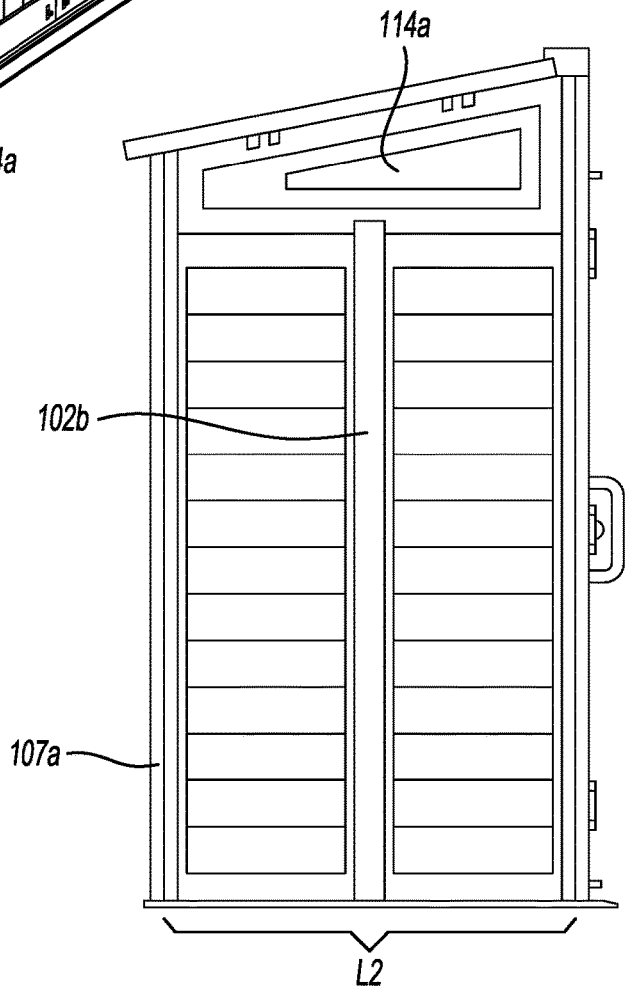
FIG. 3A illustrates a side-plan view of the exemplary storage shed illustrated in FIG. 3.

As described herein, the present disclosure contemplates storage sheds that vary in size which share several common components or parts. FIG. 3 and FIG. 3A each show a two-panel storage shed 146 including first and second sidewalls 172, 174 provided with two wall panels 108, and a rear wall 175. The first and second sidewalls 172, 174 may each include a rear extruded corner upright 107 that connects the first and second sidewalls 172, 174 to the rear wall 175.

Figure 4:
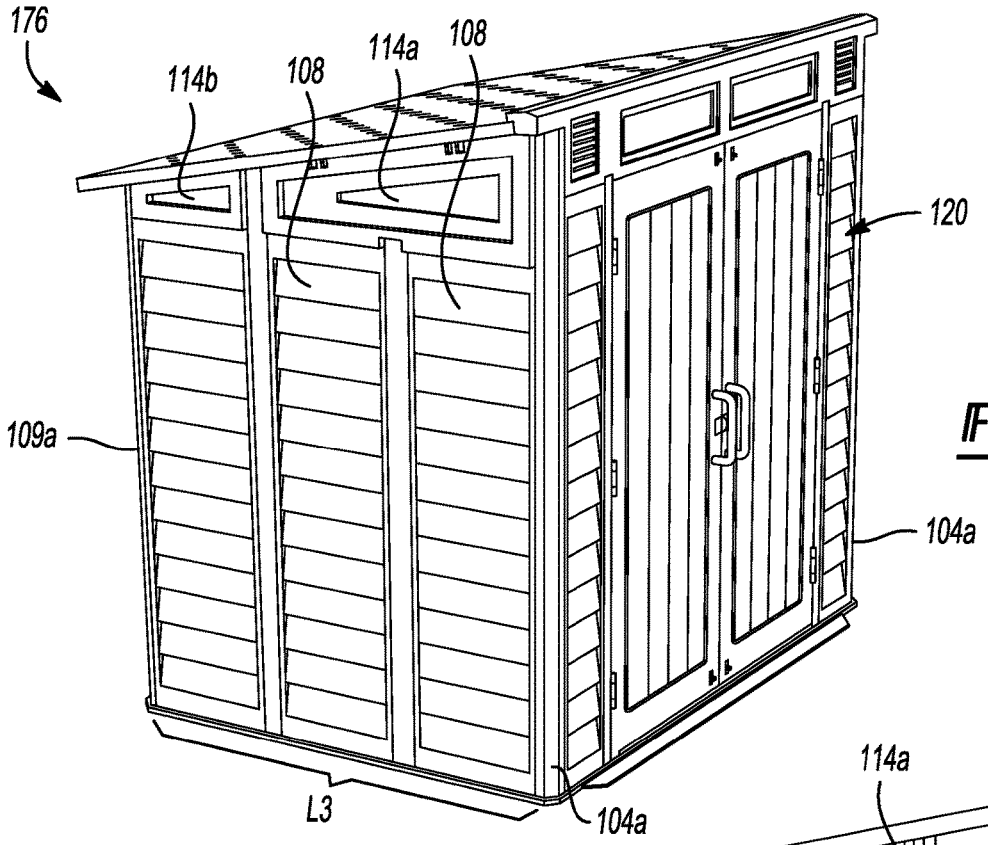
FIG. 4 illustrates a front-perspective view of an exemplary storage shed.
Figure 4A:
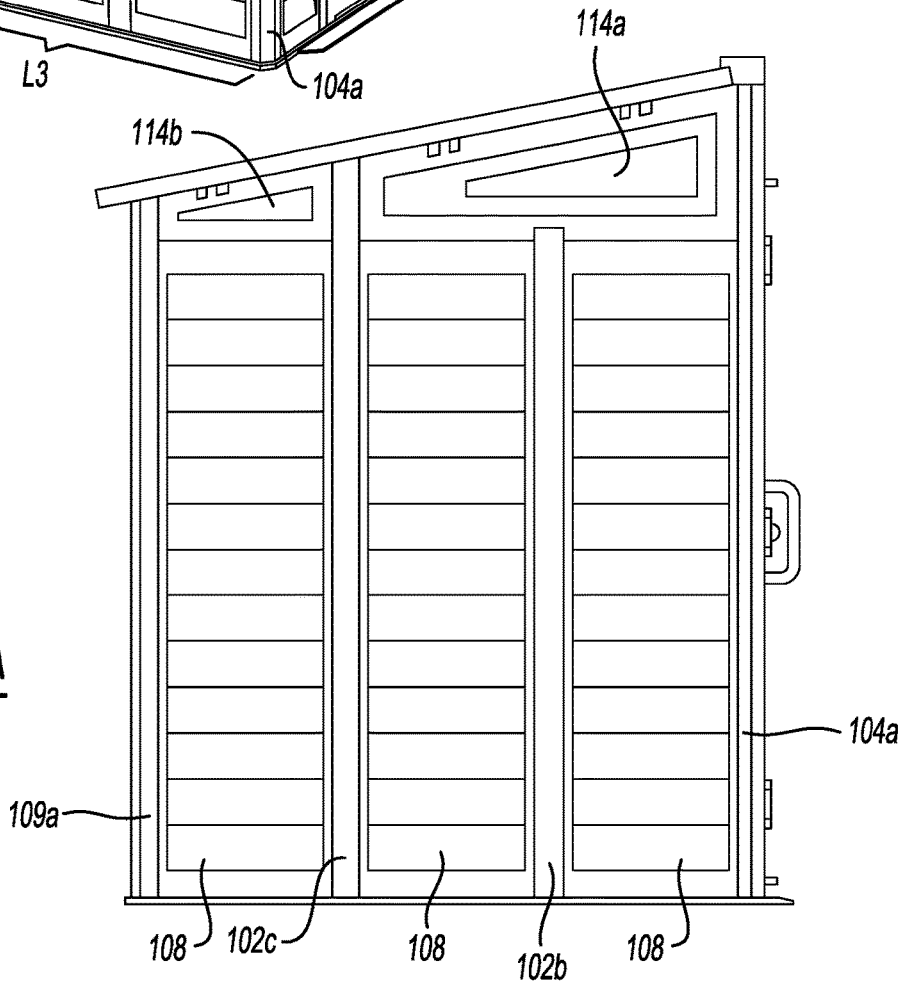
FIG. 4A illustrates a side-plan view of the exemplary storage shed illustrated in FIG. 4.

FIG. 4 and FIG. 4A each show a three-panel storage shed 176 including first and second sidewalls 178, 180, each provided with three wall panels 108, and a rear wall 183. Those components that are common or substantially identical between the sheds 100, 146, 176 are identified by common reference numbers. The first and second sidewalls 178, 180 of the three-panel storage shed 176 may be connected to the rear wall 183 by rear corner uprights 109.

Whereas the storage shed 100 shown in FIG. 1 includes sidewalls 122, 124 provided with four wall panels 108 (e.g., referred to herein as a four-panel shed 100) that form a depth or length L1, the two-panel storage shed 146 has a second length L2, and the three-panel shed 176 has a third length L3. The third length L3 is greater than the second length L2 and less than the first length L1. Accordingly, the depth or length of the sheds 100, 146, 176 vary, but the width of the sheds is the same. This common width between the sheds 100, 146, 176 enables several common components to be used for each of the sheds. However, it should be understood that in another embodiment, the width or height may vary between the sheds 100, 146, 176. What is more, while the sheds illustrated are either of the two-panel, three-panel, or four-panel configuration, the present disclosure contemplates other configurations including but not limited to one-panel, five-panel, and six-panel configurations.

As an example, each of the storage sheds 100, 136, 176 include the front wall 120. A height H1 (FIG. 2) of the front wall 120 is measured from the floor assembly 130 (e.g., bottom of the channel 204) to the roof assembly 128 (e.g., top surface of the blow-molded header 112). The rear wall 126 of the four-panel storage shed 100 has a height H2 (FIG. 14) extending from the floor assembly 130 (e.g., bottom of the channel 204) to the roof assembly 128 (e.g., the top of the rear extruded uprights 106) and each of the blow-molded wall panels 108 of the sidewalls 122, 124 have a third height H3 (FIG. 12) extending from the bottom to the top of the blow-molded wall panels 108. The blow-molded wall panels 108 of the rear wall 126 have a fourth height H4 (FIG. 16) extending from the bottom to the top of the blow-molded wall panels 108. The blow-molded door-jamb panels 110 have a fifth height H5 (FIG. 2) extending from the bottom to the top of the blow-molded door jamb panels 110.

Because the blow-molded wall panels 108 of the sidewalls 122, 124 are identical or substantially identical to the blow-molded wall panels 108 that form the rear wall 126, the third height H3 may be equal to the fourth height H4. In one or more embodiments, the first height H1 is greater than the second height H2 and the fifth height H5 is less than the first height H1. The fifth height H5 may be greater than the second height H2, the third height H3, or both of the second and third heights H2, H3.

According to one or more embodiments, the floor assembly 130 includes a number of floor panels 136 connected to one another to form a floor 140 of the shed 100 and one or more wall anchors 138 that connect the floor assembly 130 to one or more of the walls 120-126. As described herein, the floor panels 136 include overlapping and interlocking portions and the wall anchors 138 may be connected to or fixed to one or more of the walls 120-126 without the use of fasteners (e.g., a fastener-less connection) to enable easy assembly and sufficiently strong support of the walls 120-126 and the contents stored within the shed 100.

Figure 5:
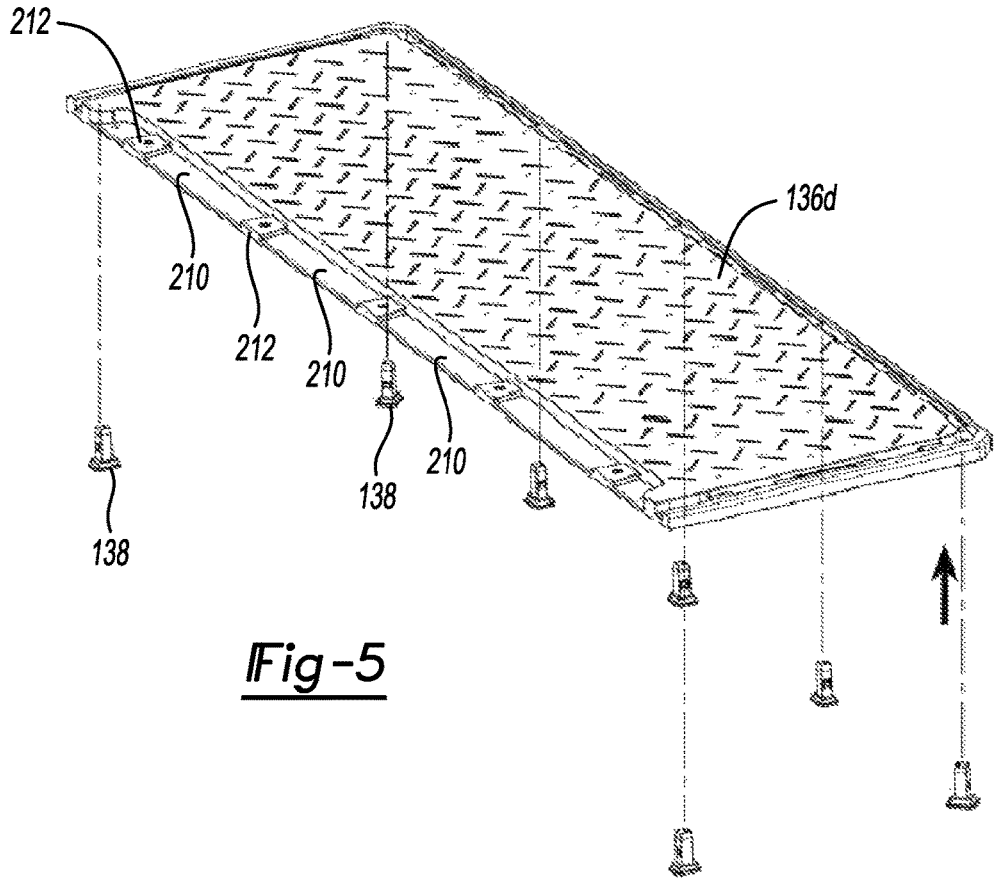
FIGS. 5-7 each illustrate a perspective-exploded view of one or more portions of an exemplary floor assembly.
Figure 6:
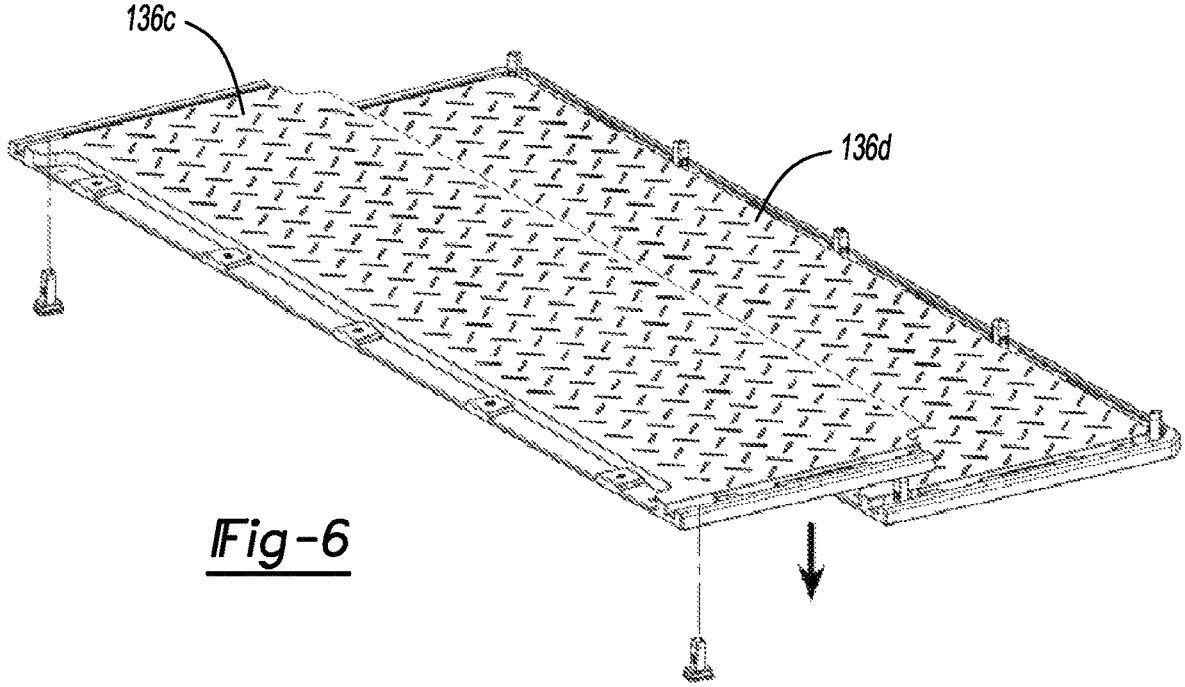
Figure 7:
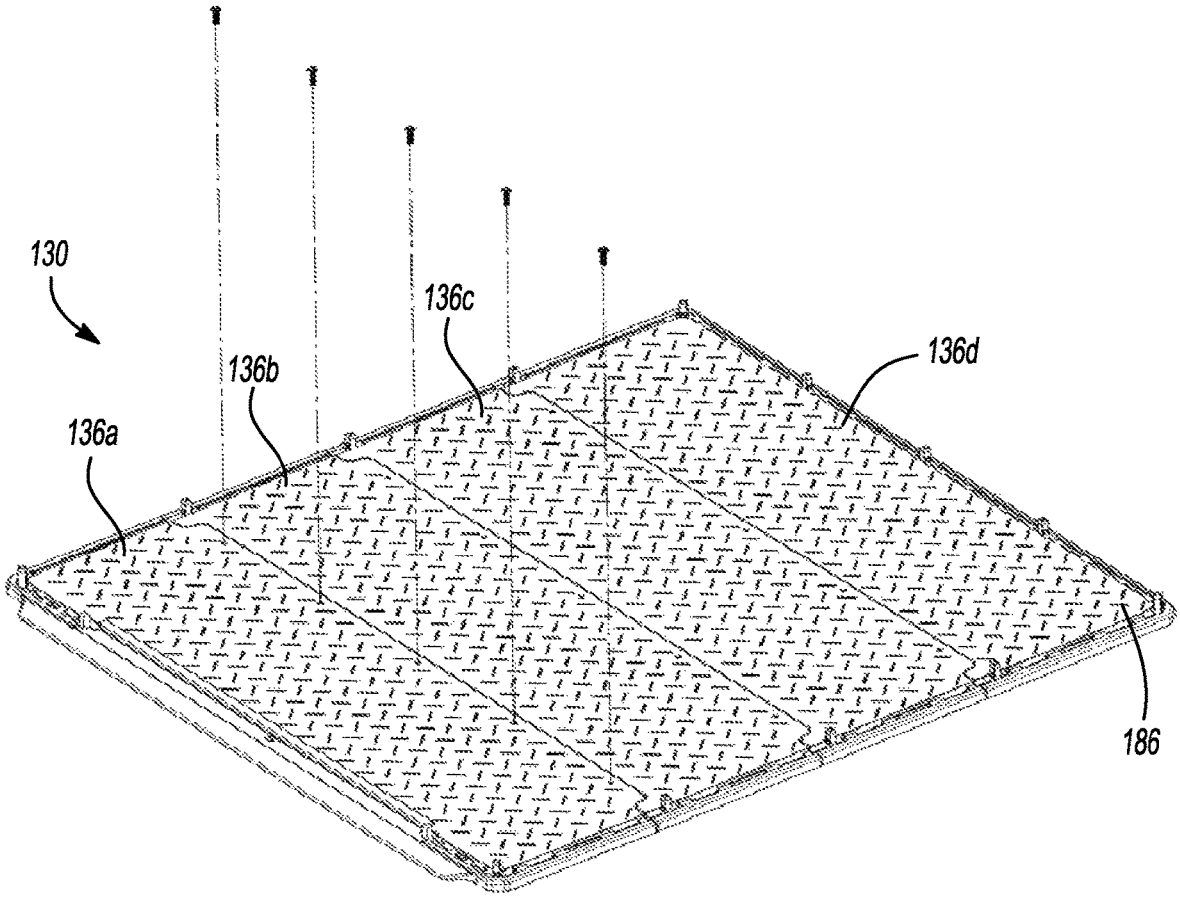

FIGS. 5-7 show one or more portions of the floor assembly 130. The floor assembly 130 includes four floor panels 136 collectively configured for use in the four-panel storage shed 100. The four floor panels 136 includes a front floor panel 136*a*, a first medial floor panel 136*b*, a second medial floor panel 136*c*, a rear floor panel 136*d*, one or more wall anchors 138, and one or more fasteners 182. When the floor assembly 130 is assembled, a shed floor surface 184 configured to support items disposed in the shed 100 is formed. The shed floor surface 184 includes anti-slip features such as raised ribs or knurling disposed along a top surface 188 of each of the floor panels 136*a*-136*d*.

Each of the floor panels 136*a*-136*d* includes a main body 186, a raised portion or raised surface 198, and a lip 200. The raised surface 198 may extend from the main body 186 in a vertical direction to form the shed floor surface 184 when the floor assembly 130 is assembled. The lip 200 extends about a periphery of at least a portion of each of the floor panels 136*a*-136*d* and is spaced apart from the raised surface 198 to form one or more recessed portions or channels 204 that are recessed with respect to the shed floor surface 184 and top surface 188 of each of the floor panels 136*a*-136*d*. As described herein, the channel 204 enables easy and fastener-less assembly of the wall panels 108, door-jamb panels 104*a*, 104*b*, and uprights 102-106 to the floor assembly 130.

One or more of the floor panels such as the rear floor panel 136*d*, the second medial floor panel 136*c*, and the first medial floor panel 136*b*, includes a connection recess 210 disposed adjacent to a front portion of the raised surface 198 of the floor panels 136*b*-136*d* and one or more connection bosses 212 disposed within each of the connection recesses 210. A rear surface of the front floor panel 136*a*, the first medial floor panel 136*b*, and the second medial floor panel 136*c* includes a connection flange 214 that covers and engages (e.g., lies along) the connection recess 210 of an adjacent floor panel 136*b*-136*d* so that portions of the floor panels 136*a*-136*d* overlap one another. The connection flanges includes one or more flange apertures 216 configured to receive a fastener 182 (e.g., pin, dowel, screw) driven into boss apertures 218 defined by one or more of the connection bosses 212 to fix the floor panels 136*a*-136*d* to one another and form the floor assembly 138.

In one or more embodiments, the floor assembly 130 may include a protrusion that may form threshold 202 disposed below and adjacent to the door opening 132. The threshold 202 may be integrally formed with and extend from the front floor panel 136*a*. It should be understood that the threshold 202 may be separate from the front floor panel 136*a* and configured for attachment thereto. The threshold 202 may be an inclined plane to enable sliding, rolling, or wheeling items (e.g., bicycle, wheel barrow, lawn mowers, large tools) along the inclined threshold 202 so that those items may be more easily placed into the storage shed 100.

Figure 8:
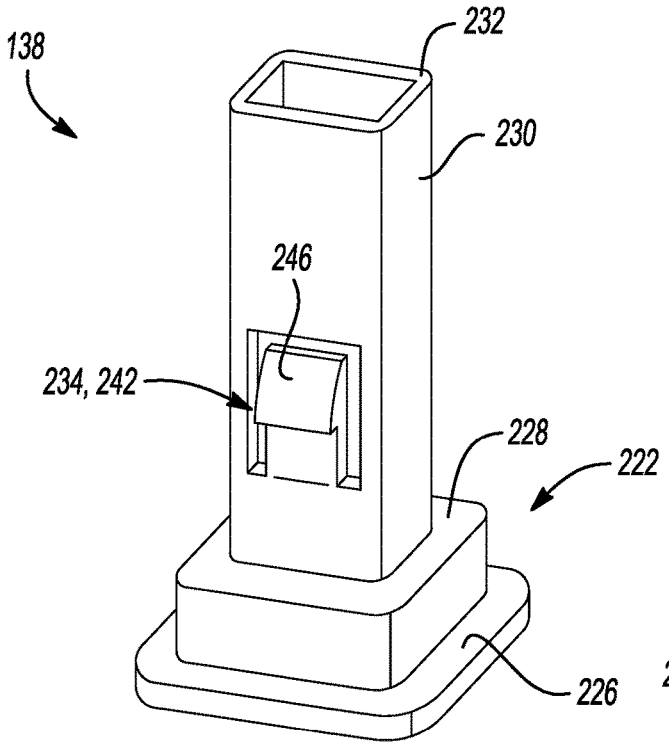
FIGS. 8-8B illustrate perspective, side-plan, and rear-plan views of an exemplary floor anchor illustrated in FIGS. 5-7.
Figure 8A:
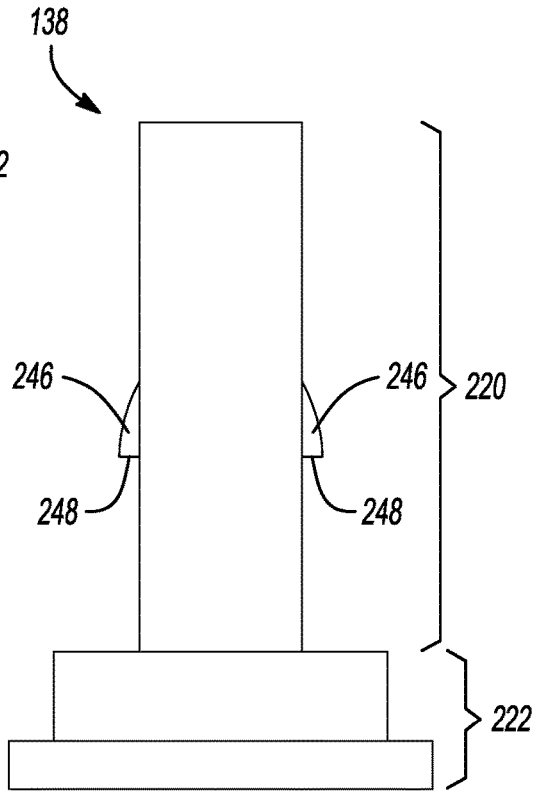
Figure 8B:
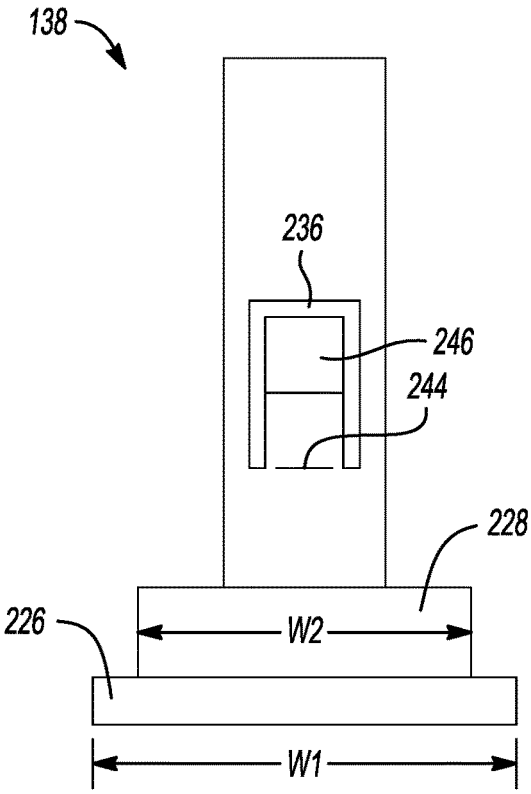
Figure 9:
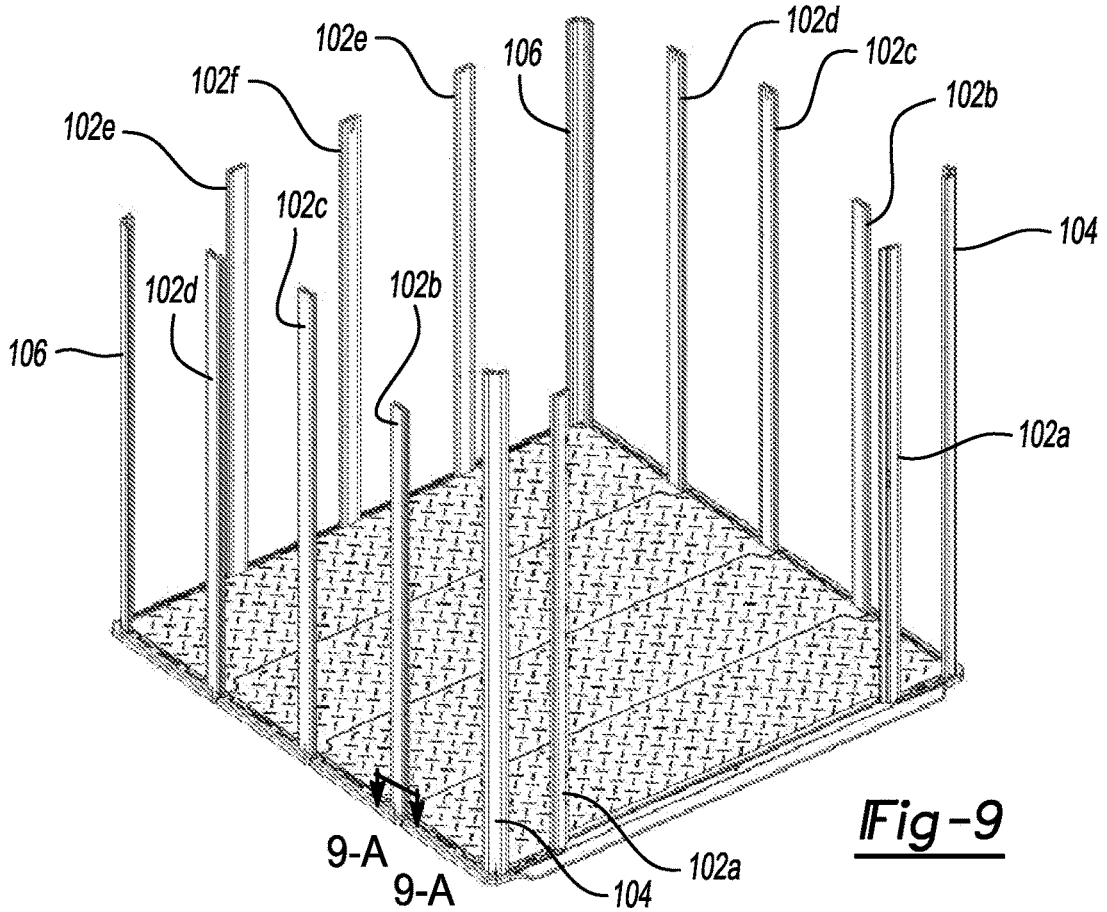
FIG. 9 illustrates a front-perspective view of a partial assembly of the shed assembly shown in FIG. 1.
Figure 9A:
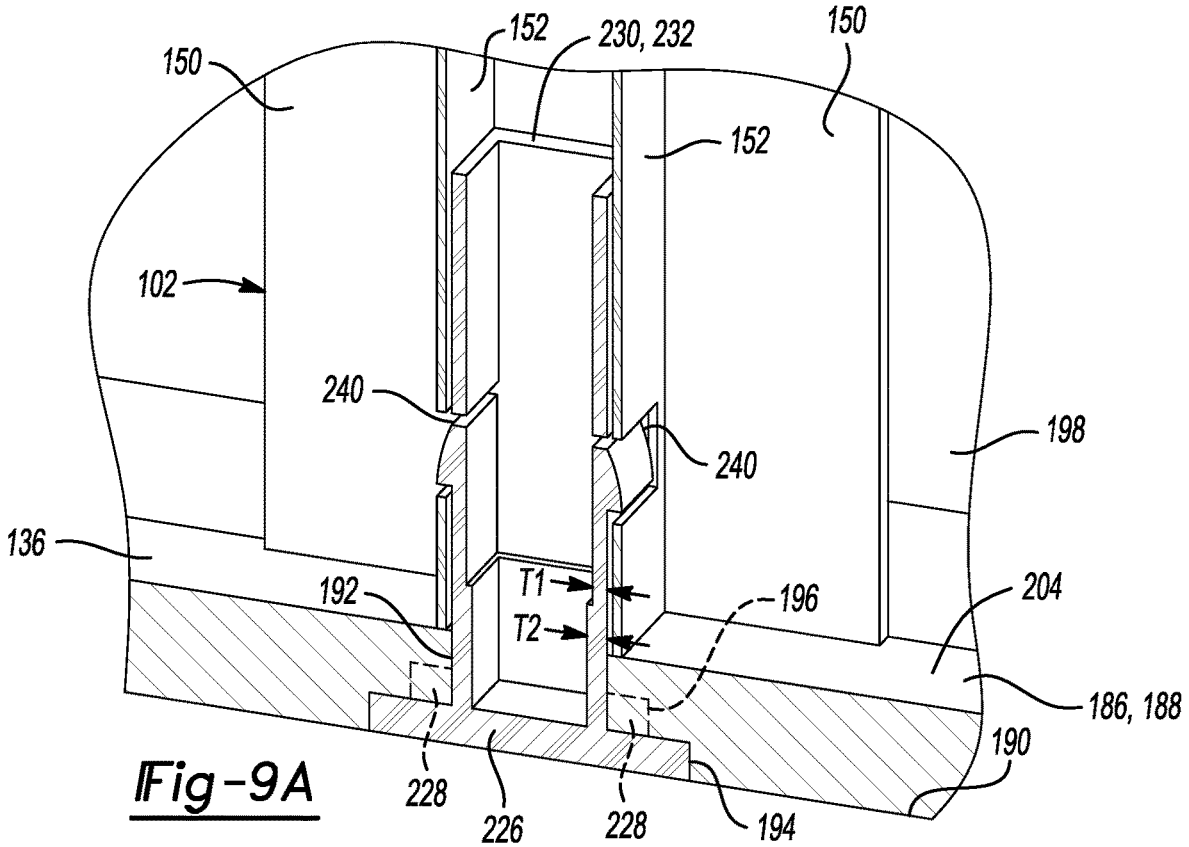
FIG. 9A illustrates a perspective-cross-sectional view taken along the lines 9-A in FIG. 10.
Figure 10:
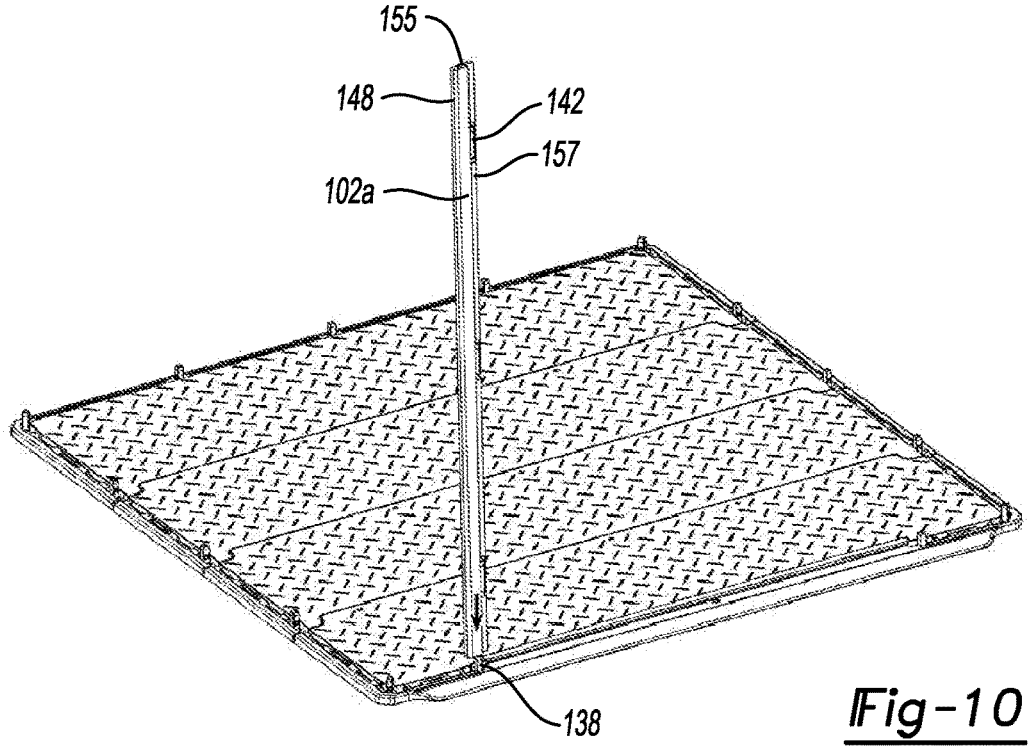
FIG. 10 illustrates a front-perspective view of a partial assembly of the shed assembly shown in FIG. 1.
Figure 11:
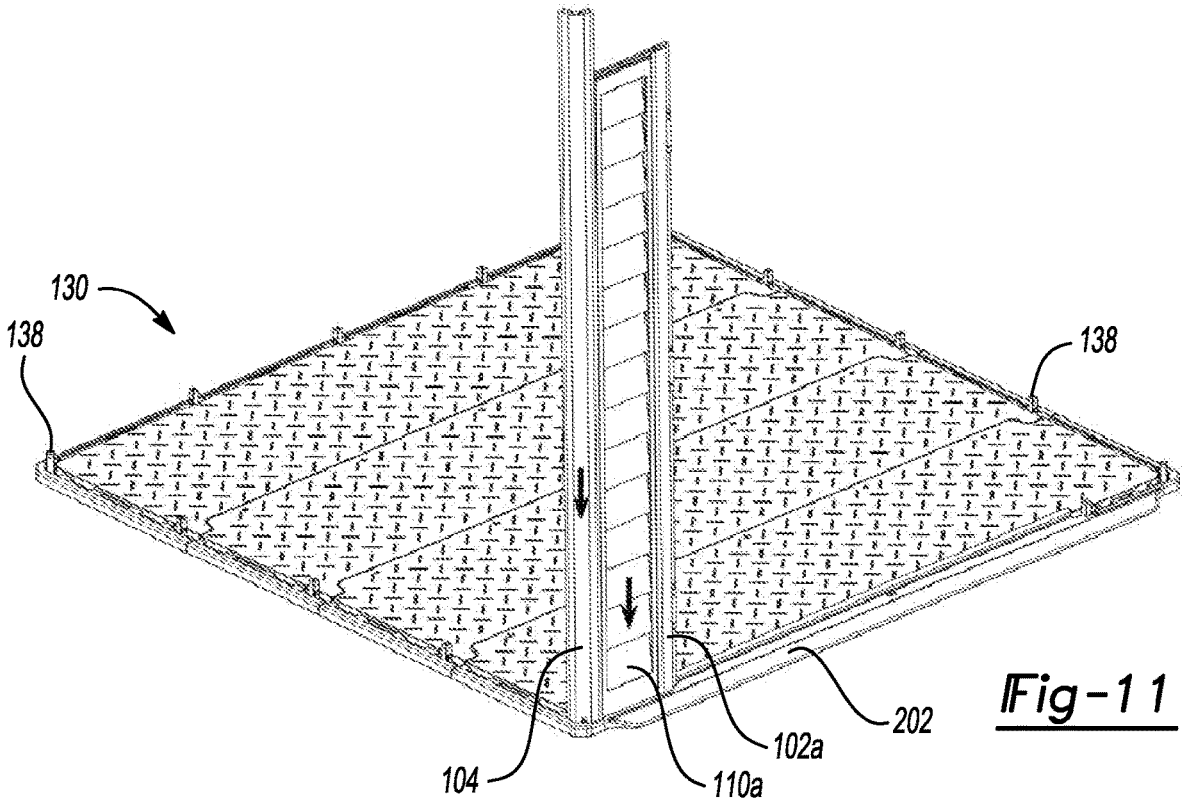
FIG. 11 illustrates a front-perspective view of a partial assembly of the shed assembly shown in FIG. 1.

FIGS. 8-8B show the wall anchor 138 according to one more embodiments. FIG. 9 shows a first partial assembly 238 of the storage shed 100 and FIG. 9A shows a cross-sectional view taken along the lines 9-A in FIG. 9. As mentioned above, the uprights 102-106 include front corner uprights 104, rear corner uprights 106, and wall uprights 102, one or more of which are connected to the floor assembly 130 by the wall anchors 138. In one or more embodiments, the wall anchor 138 includes a top portion 220 and a bottom portion 222, the top portion 220 extending from the bottom portion 222 so that when assembled to each of the floor panels 136*a*-136*d* the bottom portion 222 is substantially disposed between the top surface 188 and the bottom surface 190 of the floor panels 136*a*-136*d*. As described herein, the bottom and top portions 220, 222 enable easy assembly and a secure connection between the floor assembly 130 and the walls 120-126, and in particular, the uprights 102-106.

The main body 186 of each floor panel 136*a*-136*d* includes a bottom surface 190 which opposes the top surface 188. One or more portions of the bottom surface 190, such as peripheral portions disposed below the channel 204, include anchor apertures 192 that receive at least one wall anchor 138. Alternatively or additionally, the floor panels 136*a*-136*d* define one or more pockets 194, 196 that may be arranged coaxially with the anchor aperture 192. As an example, the wall anchors 138 may be inserted from below the bottom surface 190, into the first and second pockets 192, 194, and through the anchor aperture 192.

The wall anchor 138 includes a bottom portion 222 and a top portion 220 extending therefrom. In one or more embodiments, the bottom portion 222 may be formed by or include a pedestal 222 including a base 226 and a boss 228 and the top portion 220 may be formed by or include a post 230. The post 230 may extend from the base 226 and terminate at a free end 232. One or more portions of the wall anchor 138 include locking features configured to engage one or more portions of at least one of the uprights 102-106. As described herein, the wall anchor 138 may enable relatively quick and secure attachment between the walls 120-126 and the floor assembly 130. More specifically, the wall anchor 138 enables connecting the uprights 102-106 to the floor assembly 130 without the use of fasteners.

One or more portions of the post define a cutout 236 and one or more of the locking features, such as a retention tab 242 extends into the cutout 236. The retention tab 242 may be configured to bend or deflect inwards about a hinge portion 244. The hinge portion 244 may be a flexure bearing such as a living hinge, provided with a reduced cross-sectional area as compared to other portions of the post 230. It should be understood that the hinge portion 244 may have substantially the same cross-section as the other portions of the post 230 and configured to bend based on the material properties of the wall anchor 138. The retention tab 242 includes a retention flange 246 provided with a locking surface 248. In one or more embodiments, the retention flange 246 tapers so that the width or thickness increases from the top of the flange 246 to the bottom of the flange 246. The locking surface 248 is disposed or formed by the bottom portion of the flange 246, however, it should be understood that the locking surface 248 may be disposed on one or more sides or on the top of the flange 246, as required.

One or more portions of the wall anchor 138 may be inserted through the anchor aperture 192 so that portions (e.g., the bottom portion 222) of the wall anchor 138 are nested within the floor panel 136. As an example, the base 226 nests within an inner periphery of the first pocket 194 and the boss 228 nests within the second pocket 196, so that the wall anchor 138, or more specifically the bottom portion 222 of the wall anchor 138 is sandwiched between the floor panel 136 and the ground or surface on which the floor panel 136 is disposed. The first and second pockets 194, 196 may enable alignment or positioning of the wall anchor 138 with respect to the floor panel 136.

The uprights 102-106 may be placed over and slid over one more portions (e.g., the top portion 220) of the wall anchor 138 so that the medial walls 152 of the uprights 102-106 engage and press the retention tabs 242 inwardly so that the retention tabs 242 deflect inwardly about the hinge portion 244. One or more of the medial walls 152 of the uprights 102-106 may define an aperture such as a locking aperture 240 and as the uprights 102-106 are slid into the desired position (FIG. 9A) the locking aperture 240 may be aligned with the retention flange 246 so that the retention flange 246 disengages the medial walls 152 of the uprights 102-106 and is biased into the locking aperture 240. Upon positioning the uprights 102-106 to the desired location, the retention flange 246 and the uprights may generate a snapping or clicking sound indicating that the uprights 102-106 are connected to the wall anchors 138.

The wall uprights 102 may include first wall uprights 102*a*, second wall uprights 102*b*, third wall uprights 102*c*, fourth wall uprights 102*d*, fifth wall uprights 102*e*, and a sixth wall upright 102*f*. In one embodiment, the first wall uprights 102*a* may be disposed between and spaced apart from the front corner uprights 104 so that the first door-jamb panel 110*a* may be inserted between one of the corner uprights 104 and one of the first wall uprights 102*a* and the second door-jamb panel 110*b* may be inserted between the other of the corner uprights 104.

FIG. 10 through FIG. 15B show portions of the four-panel shed 100 as the shed 100 is assembled according to one or more embodiments. More specifically, FIG. 10 through FIG. 13 show the assembling of the sidewalls 122-126 to the floor assembly 130. After assembling the floor assembly 130, one or more wall anchors 138 may be disposed about the outer periphery as described above. One of the first wall uprights 102*a* (which may also be referred to as a first extruded door-jamb wall upright) may be slid over or onto a wall anchor 138 that may be disposed adjacent to the threshold 202, to fix the first wall upright 102*a* to the floor assembly 130. The first extruded door-jamb wall upright 102*a* includes a receptacle 155 disposed between the groove or slot 148 and a hinge beam 157. The hinges 142 may be attached to or integrally formed with the hinge beam 157 and the receptacle 155 may be configured to receive and engage the wall anchor 138.

The first door-jamb wall panel 110*a* (e.g., the tongue 162) may be inserted into a channel or receptacle 154 of the first wall upright 102*a*, along the direction indicated by the directional arrow, until the first door-jamb wall panel 110*a* is seated in the channel 204 (FIG. 9A). The first front corner upright 104 may be slid onto the other tongue 162 of the first door-jamb wall panel 110*a* and onto one of the wall anchors 138 so that the first front corner upright 104 is secured to the floor assembly 130.

Figure 12:
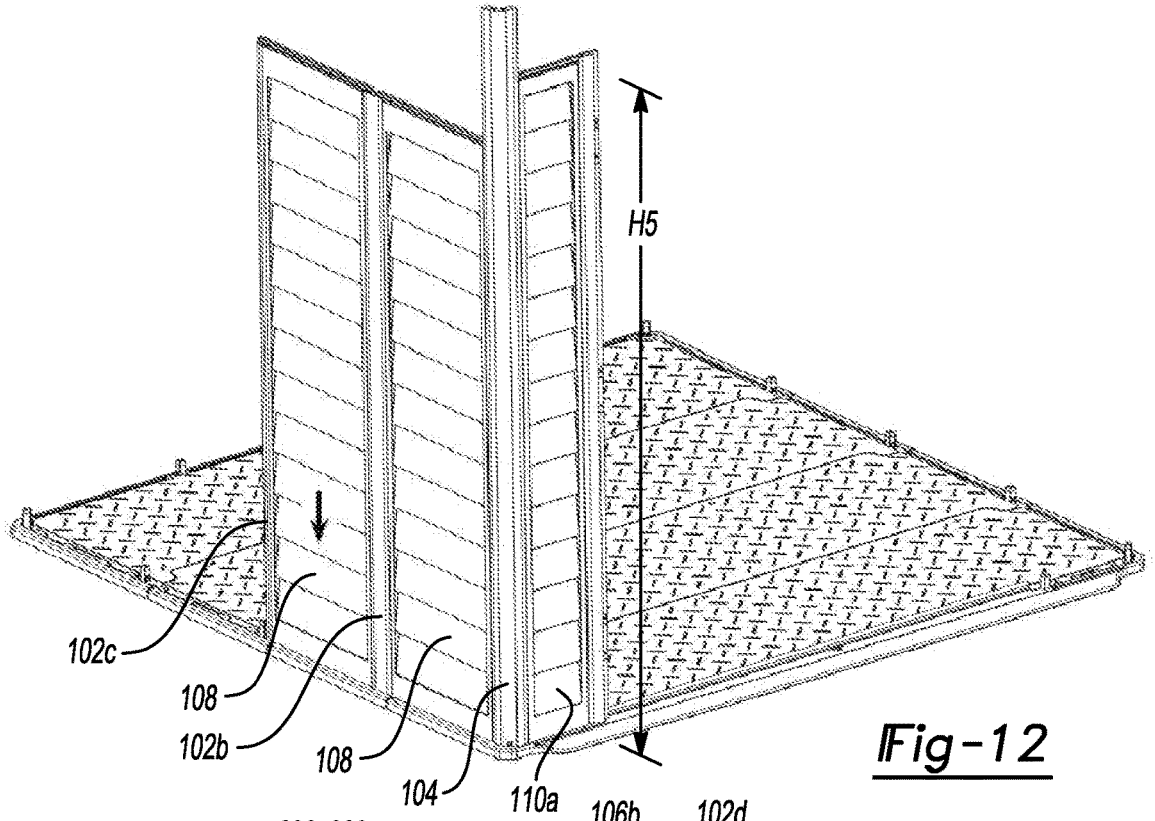
FIG. 12 illustrates a front-perspective view of a partial assembly of the shed assembly shown in FIG. 1.

Referring specifically to FIG. 12, one of the blow-molded wall panels 108 may be inserted into the first front corner upright 104 and into the channel 204 (FIG. 9A) and one of the second wall uprights 102*b* may be slid over or inserted onto the blow-molded wall panel 108 that is directly connected to the first front corner upright 104. The attachment of one or more of the wall uprights 102, such as the third wall upright 102*c*, to an adjacent wall panel 108 and the floor assembly 130 (e.g., via the wall anchor 138) may be accomplished in one assembly step and without the use of fasteners or other hardware. As an example, another blow-molded wall panel 108 may then be slid into an adjacent receptacle 154 of the second wall upright 102*b* and one of the third wall uprights 102*c* (e.g., receptacle 154 of the third wall upright 102*c*) may be slid onto the second blow-molded wall panel 108 (e.g., the tongue 162 of the second blow-molded wall panel 108. This process may be repeated along the directional arrows shown disposed above the four-panel shed 100 to form bottom portions of the first sidewall 122, rear wall 126, second sidewall 124, and the front wall 120.

Figure 14:
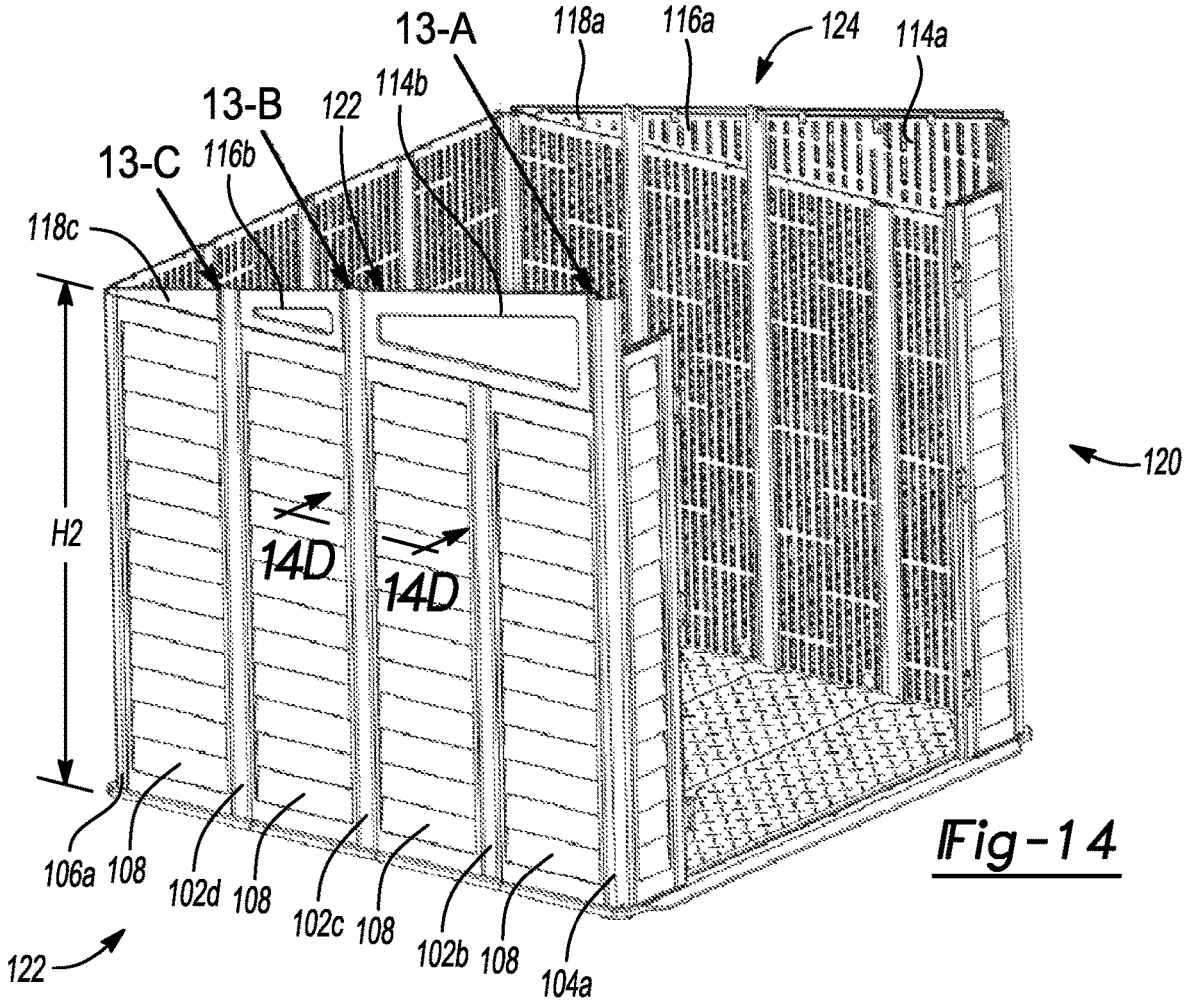
FIG. 14 illustrates a front-perspective view of a partial assembly of the shed assembly shown in FIG. 1.

FIG. 14 shows a perspective view of the four-panel storage shed after the front blow-molded roofline panels 114, the middle blow-molded roofline panels 116, and the rear blow-molded roofline panels 118 are assembled to form the first and second sidewalls 122, 124. The blow-molded roofline panels 114-118 be collectively configured to support the roof assembly 128 (FIG. 1) and couple the roof assembly 128 to the blow-molded wall panels 108, which, in conjunction with the roofline panels 114-118, form the walls 120-126.

One or more of the roofline panels 114-118 (e.g., all) may taper from the front (e.g., portions of the roofline panels 114-118 disclosed closer to the front wall 120) to the rear (e.g., portions of the roofline panels 114-118 disclosed closer to the rear wall 126). In one or more embodiments, one or more of the roofline panels 114-118 may include one or more recess sections. As an example, the front roofline panels 114 include a recess section 264 and the middle roofline panels 116 include another recess section 266 (FIG. 14). The recess sections 264, 266 may be provided to reduce the weight of the roofline panels 114, 116, provide an aesthetically pleasing design, or both.

As previously mentioned, slots or channels 148 are provided in the wall uprights 102 and the corner uprights 104, 106, the wall uprights 102 each include the receptacle 154, and the corner uprights 104, 106 include the receptacle 168. The slots or channels 148 are configured to receive one or more portions of the blow-molded wall panels 108 (e.g., the tongues 162) and the receptacles 154, 168 are configured to receive one of the wall anchors 138 to secure the walls 120-126 to the floor assembly 130. In one or more embodiments, one or more of the roofline panels 114-116 are configured to form a rigid and fastener-less connection (e.g., a form-fitting or press-fit connection) between the roofline panels 114-116 and the wall uprights 102 and the corner uprights 104, 106. As an example, the front roofline panel 114 includes a front tongue 254 and a rear tongue 256, the middle roofline panel 116 includes a front tongue 258 and a rear tongue 260, and the rear roofline panel 118 includes a front tongue 262 and a rear tongue 264 (FIG. 14).

Figure 13:
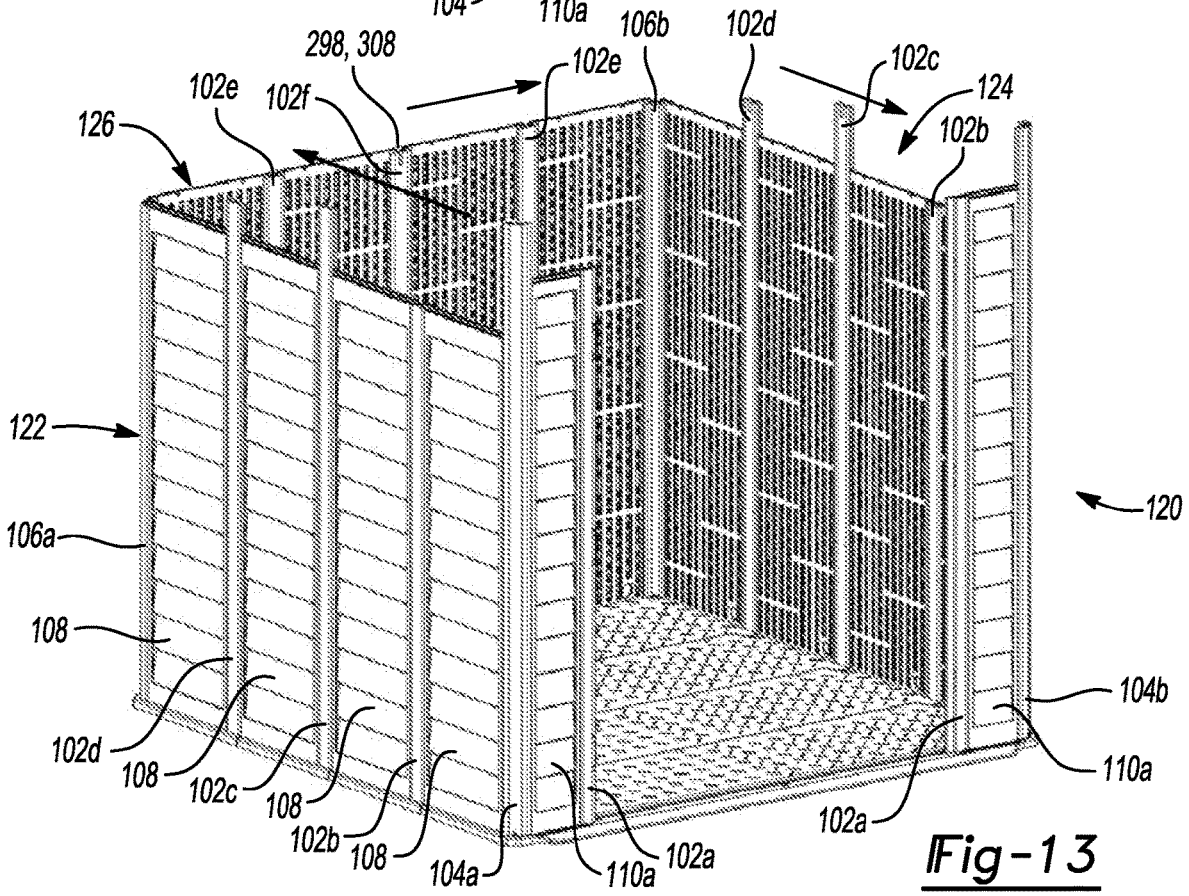
FIG. 13 illustrates a front-perspective view of a partial assembly of the shed assembly shown in FIG. 1.
Figure 14A:
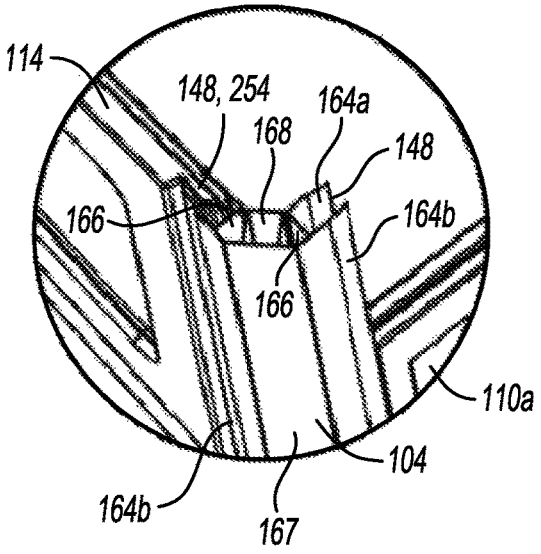
FIGS. 14A-14C each illustrate detail views taken along lines 14-A, 14-B, 14-C in FIG. 14, respectively.

FIG. 14A shows a detailed view of the connection between the first front corner wall upright 104*a* and the front blow-molded roofline panel 114 and the blow-molded first door jamb panel 110*a*. The front corner upright 104 includes the receptacle 168 formed by the medial walls 166 and connecting walls 167, and flanges 164*a*, 164*b*, extending from the walls 166, 167 form the grooves or channels 148. One channel 148 of the first corner upright 108 receive the tongue 162 of the wall panel 108 (FIG. 13-D) and the other channel 148 receives the front tongue 254 of the front roofline panel 114 as well as the tongue 162 of an adjoining wall panel 108 (not shown in FIG. 13-A).

Figure 14B:
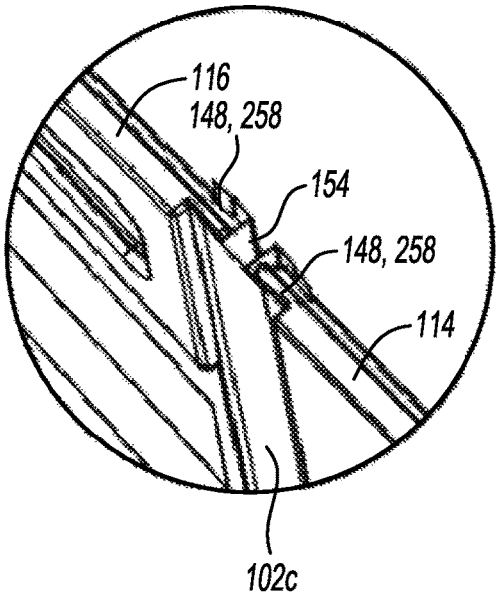

FIG. 14B shows a detailed view of the connection between the third extruded wall upright 102*c* and the front blow-molded roofline panel 114 and the middle blow-molded roofline panel 116. The front tongue 258 of the middle roofline panel 116 is slid into the groove or channel 148 of the third wall upright 102*c* and the rear tongue 256 of the front roofline panel 114 is slid into the groove or channel 148 to form a form-fitting or press-fitting connection between the third wall upright 102*c* and the front and middle roofline panels 114, 116.

Figure 14C:
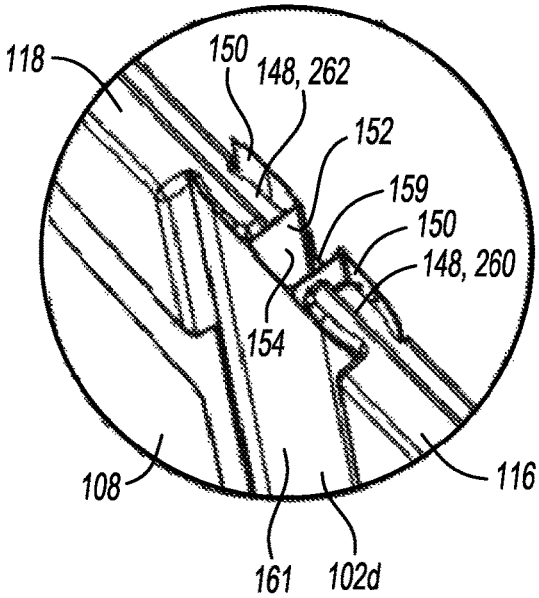

FIG. 14C shows a detailed view of the connection between the fourth wall upright 102*d* and the rear roofline panel 118 and the middle roofline panel 116. The rear tongue 260 of the middle roofline panel 116 is slid into the groove or channel 148 of the fourth wall upright 102*d* and the front tongue 262 of the rear roofline panel 118 is slid into the other groove or channel 148 of the fourth wall upright 102*d* to form a form-fitting or press-fitting connection between the third wall upright 102*c* and the rear and middle roofline panels 118, 116.

Figure 14D:
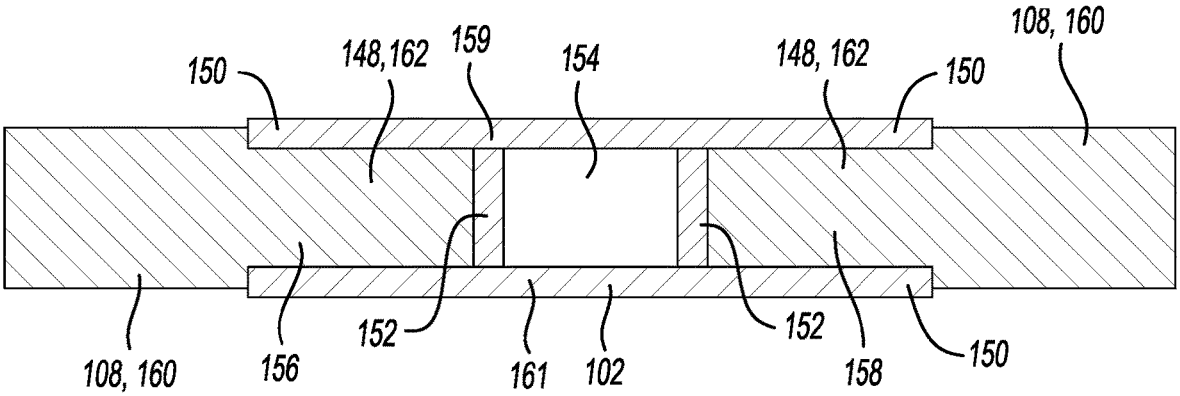
FIG. 14D illustrates a cross-sectional view taken along lines 14-D in FIG. 14.

FIG. 14D shows a detailed view of the connection between the fourth extruded wall upright 102*d* and the middle blow-molded roofline panel 116 and the rear blow-molded roofline panel 118. One or more of the wall uprights 102 include an inner wall 159 and an outer wall 161 that may be connected to one another by the medial walls 152, and portions of the inner and outer walls 159, 161 may form the flanges 150 of the wall uprights 102. As shown in FIG. 13-C, the inner wall 159 may be shorter than the outer wall 161 or portions of the inner wall 159 may not extend to a distal end of the wall upright 102. The flanges 150 form the grooves or slots 148 disposed on each side of the receptacle and configured to receive the first end portion 156 (e.g., a tongue 162 of one of the wall panels 108) and a second end portion 158 (e.g., a tongue 162 of another wall panel 108).

Figure 15A:
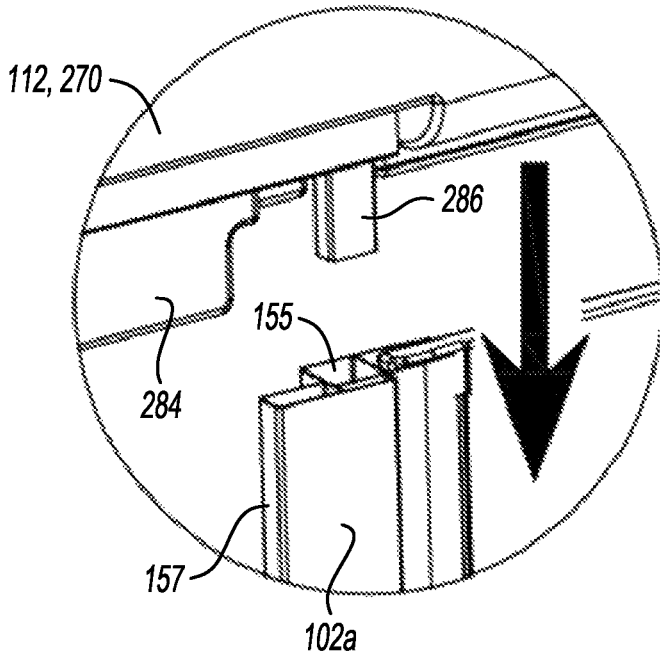
FIG. 15A illustrates a detail view taken along the lines 15-A in FIG. 15.
Figure 15B:
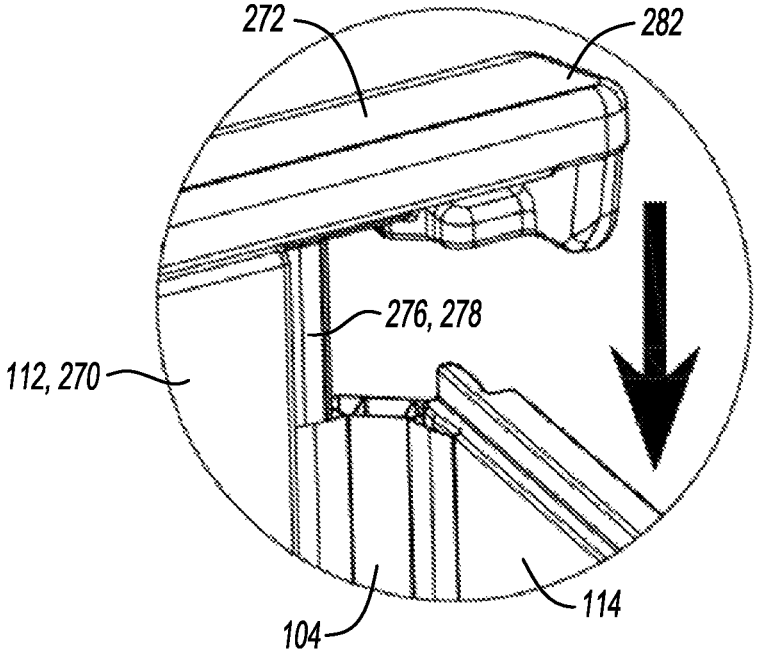
FIG. 15B illustrates a detail view taken along the lines 15-B in FIG. 15.

FIG. 15 shows assembling of the blow-molded header 112 to form the front wall 120. FIG. 15A and FIG. 15B each show detail views taken along the lines 15-A and 15-B in FIG. 15, respectively. As described herein, the blow-molded header 112 may be fixed or connected to the first and second sidewalls 122, 124 relatively easily and without the use of fasteners or other hardware. The blow-molded header includes a main body 270 and a top rail 272 that may extend from the main body 270. The main body 270 includes a first end 274 and a second end 276, the first end 274 and the second end 276 each include a tongue 278 that is configured to be inserted (e.g., in a direction extending along the directional arrows) into the portions (e.g., the slots or grooves 148) of the front corner uprights 104. First and second ends 280, 282 of the top rail 272 may be spaced apart from the first and second ends 274, 276 of the main body 270 and cover or overlap portions of the first and second sidewalls 122, 124 when the blow-molded header 112 is installed.

Alternatively or additionally, one or more tabs 286 may extend from a bottom portion of the main body 270 of the blow-molded header and the tabs 286 may be inserted into the slots or grooves 148 of the first and second extruded door-jamb uprights 102*a*. The blow-molded header 112, the first and second extruded door-jamb uprights 102*a*, and the floor assembly 130 collectively form the door opening 132. In one or more embodiments, the blow-molded header 112 may include one or more door stops configured to abut against the first and second doors 134*a*, 134*b* when the doors are assembled to the first and second extruded door-jamb uprights 102*a* and disposed in the closed position (FIG. 1). As an example, an astragal 284 may be integrally formed with the main body 270 of the blow-molded header 112 and the astragal may form the stop for the doors 134*a*, 134*b*. The astragal 284 may be disposed between the tabs 286 that are received by the first and second extruded door-jamb uprights 102*a*.

Figure 16:
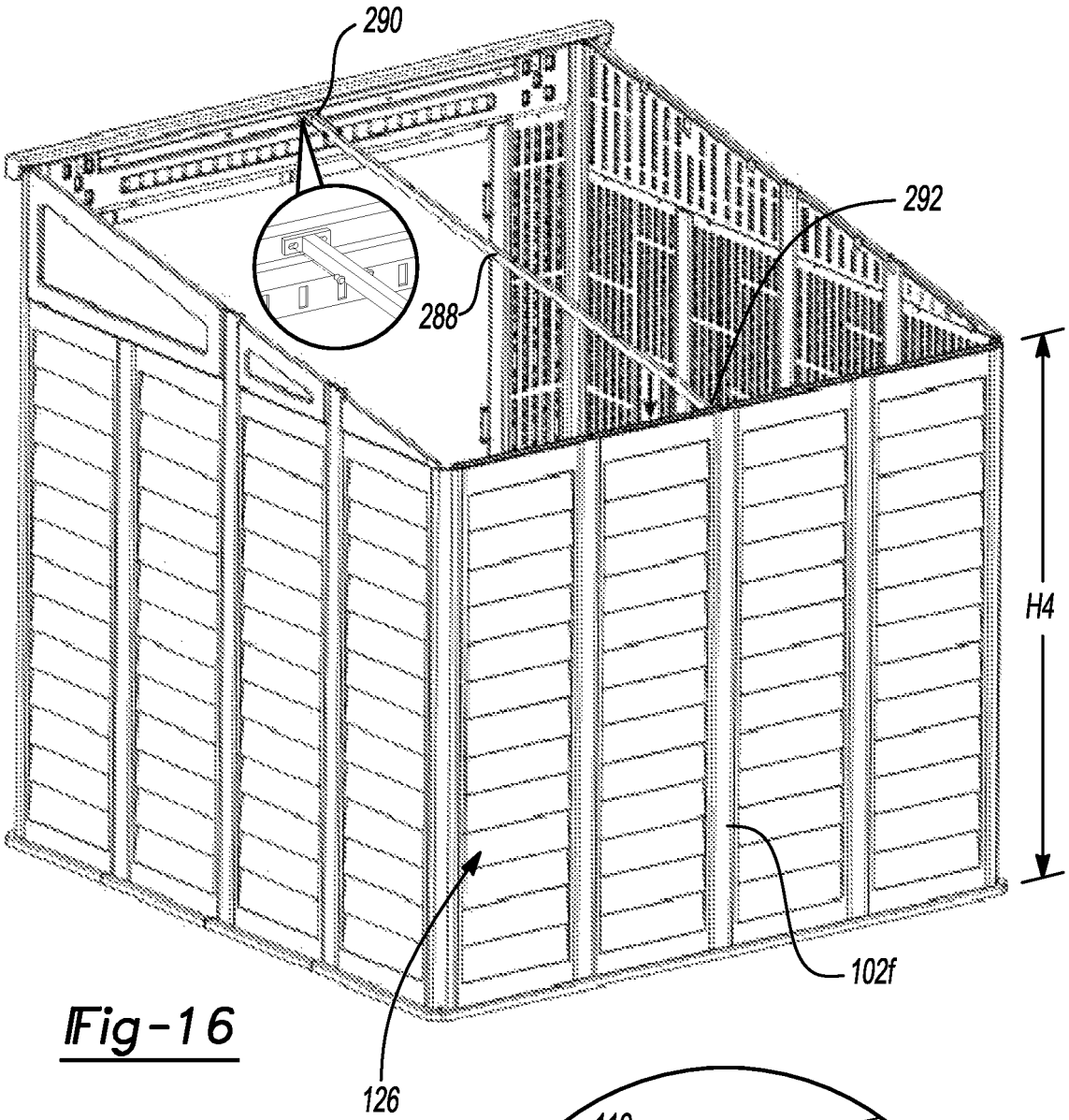
FIG. 16 illustrates a rear-perspective view of a partial assembly of the shed assembly shown in FIG. 1.
Figure 16A:
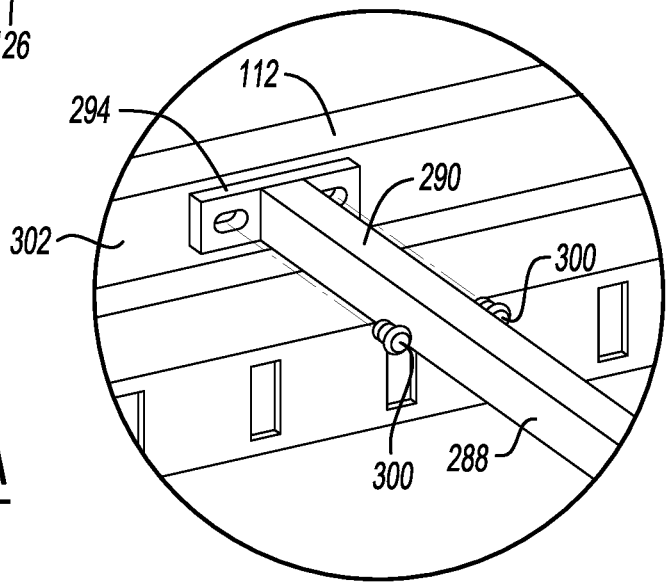
FIG. 16A illustrates a detail view taken along lines 16-A in FIG. 16.
Figure 17:
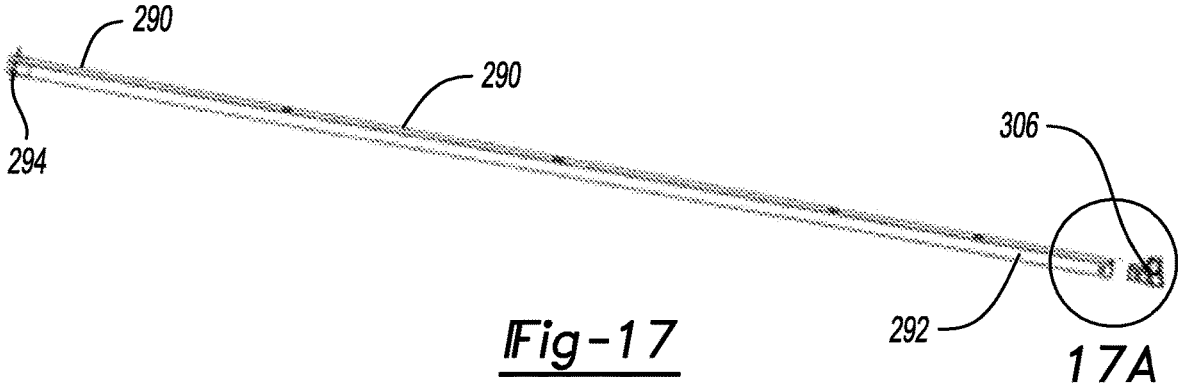
FIG. 17 illustrates a perspective view of a portion of a roof assembly shown in FIG. 16.
Figure 17A:
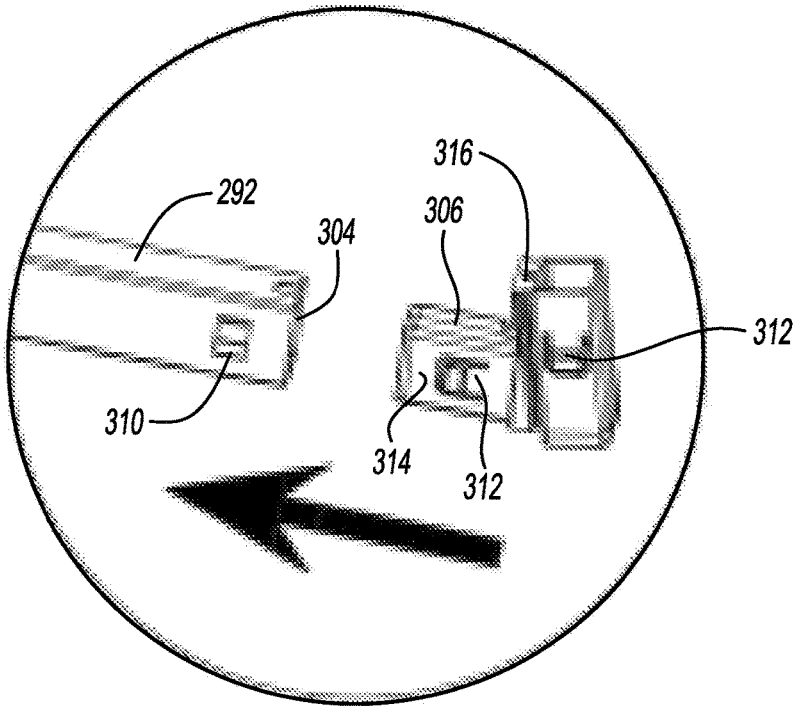
FIG. 17A illustrates a detail view taken along lines 17-A in FIG. 17.

FIG. 16 shows assembling of a longitudinal roof 288 beam to the four-panel storage shed 100. FIG. 16A shows a detailed-perspective view taken along the lines 16-A in FIG. 16. FIG. 17 shows an exploded perspective view of the longitudinal roof beam 288 and FIG. 17-A shows a detailed view taken along the lines 17-A in FIG. 17. The longitudinal roof beam includes a first end 290 and a second end 292, the first end 290 may be configured for attachment to the blow-molded header 112 and the second end 292 may be configured for attachment to one or more portions (e.g., the sixth extruded wall upright 102*f*) of the rear wall 126. In one or more embodiments, the first end 290 includes a flange 294 configured to receive one or more fasteners 300 that are driven into the blow-molded header 112. As an example, the blow-molded header 112 may include a recessed portion 302 that receives the flange 294.

The second end 292 of the longitudinal beam 290 includes an open end 304 that may be configured to receive a connector, such as a socket 306. The socket 306 includes a first portion 314 and a second portion 316 that may be integrally formed with and substantially orthogonal to the first portion 314. The first portion 314 may be inserted into an open end 304 of the second end 292 of the longitudinal roof beam 290, and the second portion 316 may be fixed to the rear wall 126. As an example, one of the extruded wall uprights 102 (e.g., the sixth extruded wall upright 102*f*) may receive the second portion 316 of the socket 306.

The sixth extruded wall upright 102*f* includes a proximal end 296 (FIG. 15) and a distal end 298 (FIG. 13) that defines an aperture 308 that receives the second portion 316 of the socket 306. As an example, the second portion 316 may have a T-shaped cross-section for engagement with an inner periphery of the aperture 308 defined by the distal end 298 of the sixth wall upright 102*f*. As described herein, attachment of the second end 292 of the longitudinal roof beam 290 to the socket 306 and the rear wall 126 may be accomplished without the use of fasteners or external hardware. The second end 292 of the longitudinal roof beam 290 may define one or more retention apertures 310. The one or more retention apertures 310 may receive a retention tab 312 disposed on the first portion 314 of the socket 306.

Figure 18:
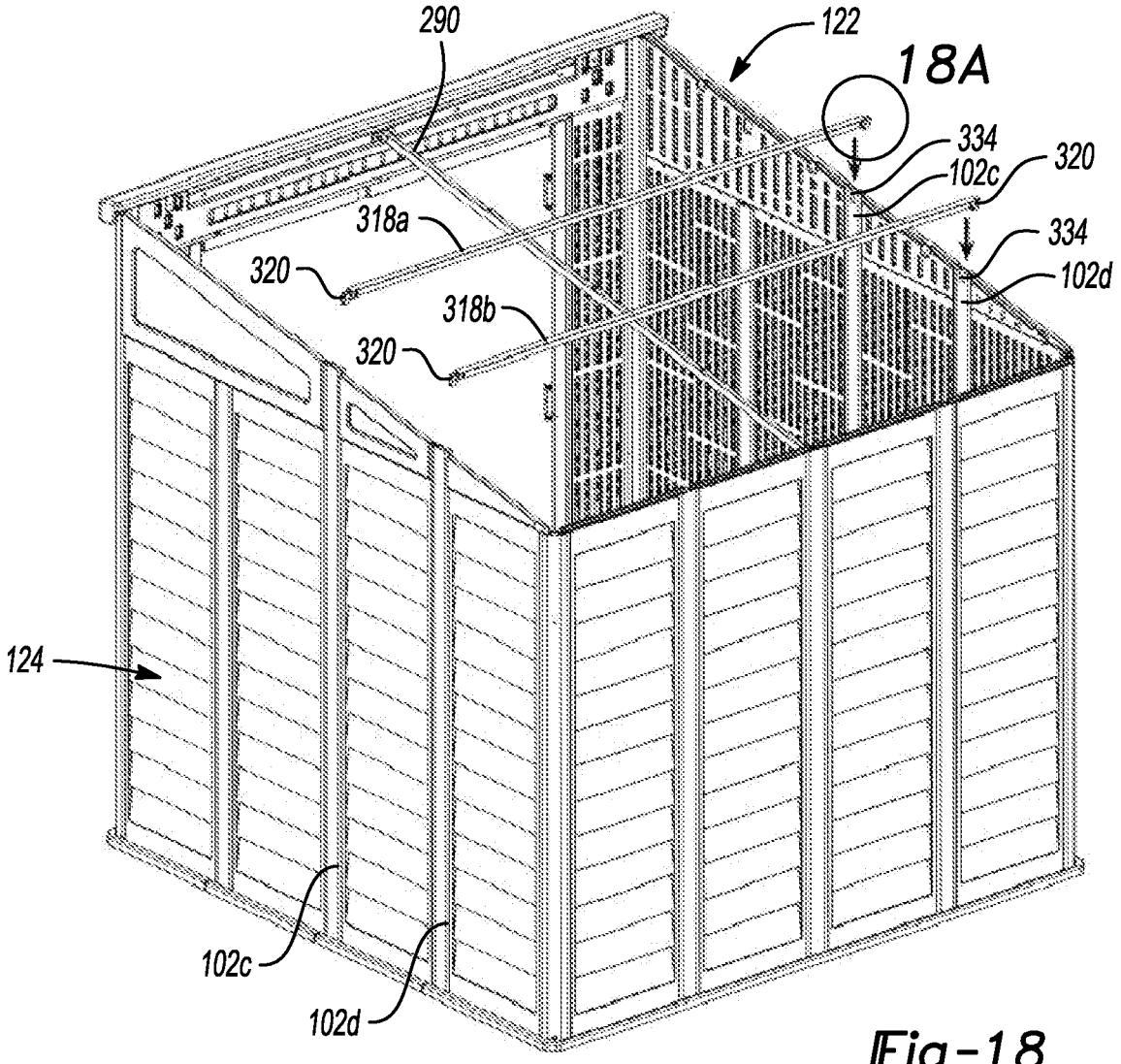
FIG. 18 illustrates a rear-perspective view of a partial assembly of the shed assembly shown in FIG. 1.
Figure 18A:
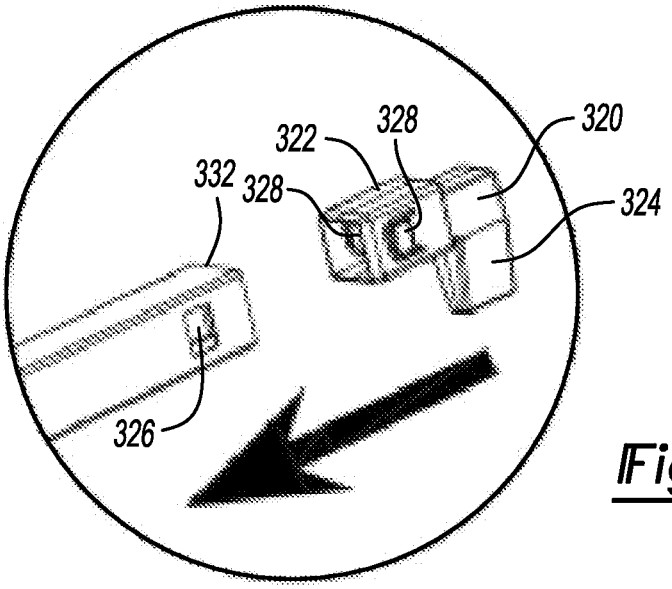
FIG. 18A illustrates a detail view taken along lines 18-A in FIG. 18.
Figure 19:
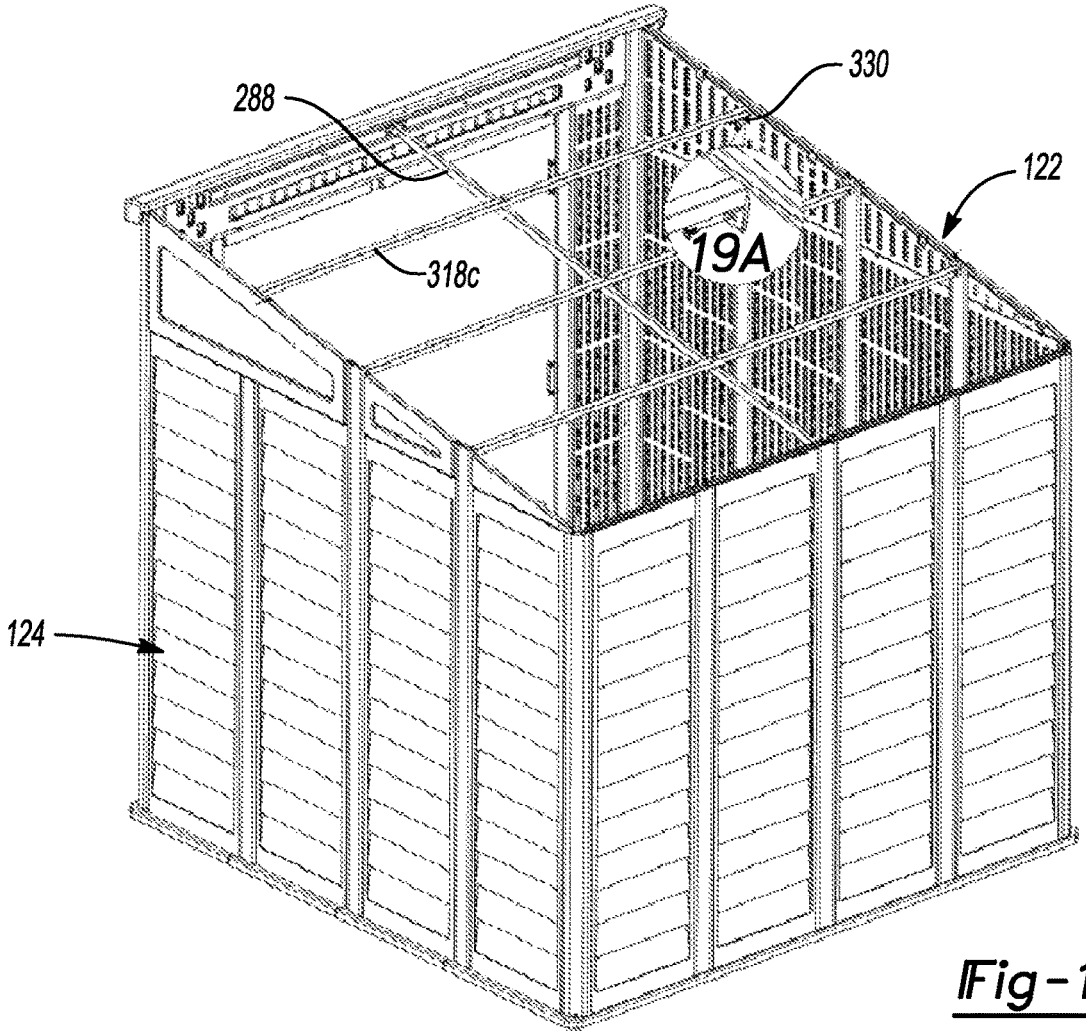
FIG. 19 illustrates a rear-perspective view of a partial assembly of the shed assembly shown in FIG. 1.
Figure 19A:
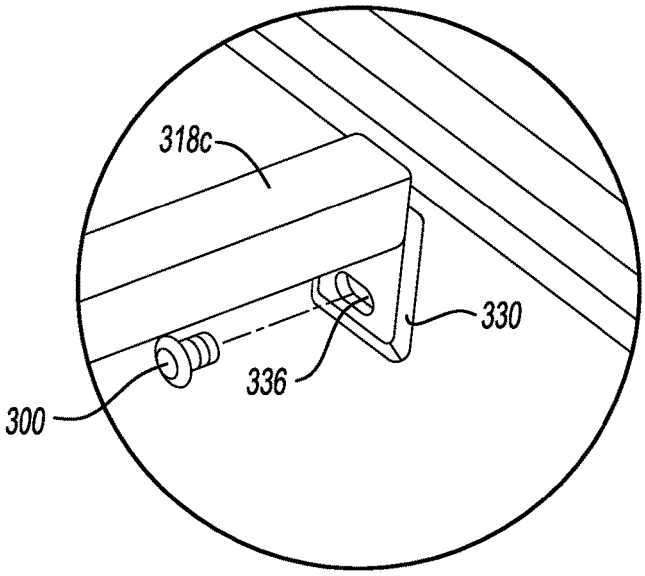
FIG. 19A illustrates a detail view taken along lines 19-A in FIG. 19.

FIG. 18 shows assembling of first and second lateral roof beams 318*a*, 318*b* to the first and second sidewalls 122, 124, and FIG. 18A shows a detail-exploded view taken along lines 18-A in FIG. 18. FIG. 19 shows attaching a third lateral roof beams 318*c* to the first and second sidewalls 122, 124, and FIG. 19A shows a detailed view taken along the lines 19-A in FIG. 19. The first lateral roof beam 318*a* and the second lateral roof beam 318*b* each include connectors 320 that enable fastener-less connection between the first and second lateral roof beams 318*a*, 318*b* and the first and second sidewalls 124, 126.

The connector 320 includes a socket 324 and a buckle 322 extending from the socket 324. The socket 324 may be inserted into an open end 332 of the first and second lateral roof beams 318*a*, 318*b*. However, it should be understood that in other embodiments, the socket 324 may be configured to receive the open end 332 of the first and second lateral roof beams 318*a*, 318*b*. The socket 324 may include one or more retention tabs 328 that may inserted into and engage retention apertures 326 defined by each end of the first and second lateral roof beams 318*a*, 318*b*. The third and fourth extruded wall uprights 102*c*, 102*d* may each define an aperture 334 and the buckle 324 may be inserted (e.g., in a direction extending along the directional arrows) into apertures 334. As an example, the buckle 324 may be tapered to form a press-fit connection between the buckle 324 and the third and fourth extruded wall uprights 102*c*, 102*d*.

Flanges 330 may be disposed at each end of the third lateral roof beam 318*c*, and the flanges 330 may include an aperture (e.g., slot 336) that may receive the fastener 300 to fix each end of the third lateral roof beam 318*c* to the first and second sidewalls 122, 124. The first, second, and third lateral roof beams 318*a*, 318*b*, 318*c* may be disposed above the longitudinal roof beam 288 and the longitudinal roof beam 288 may be positioned orthogonally to the first, second, and third lateral roof beams 318*a*, 318*b*, 318*c*. In one or more embodiments, the first, second, and third lateral roof beams 318*a*, 318*b*, 318*c* lay on top of the longitudinal roof beam 288 and one or more fasteners (e.g., screws) connect the longitudinal roof beam 288 to the first, second, and third lateral roof beams 318*a*, 318*b*, 318*c*.

Figure 20:
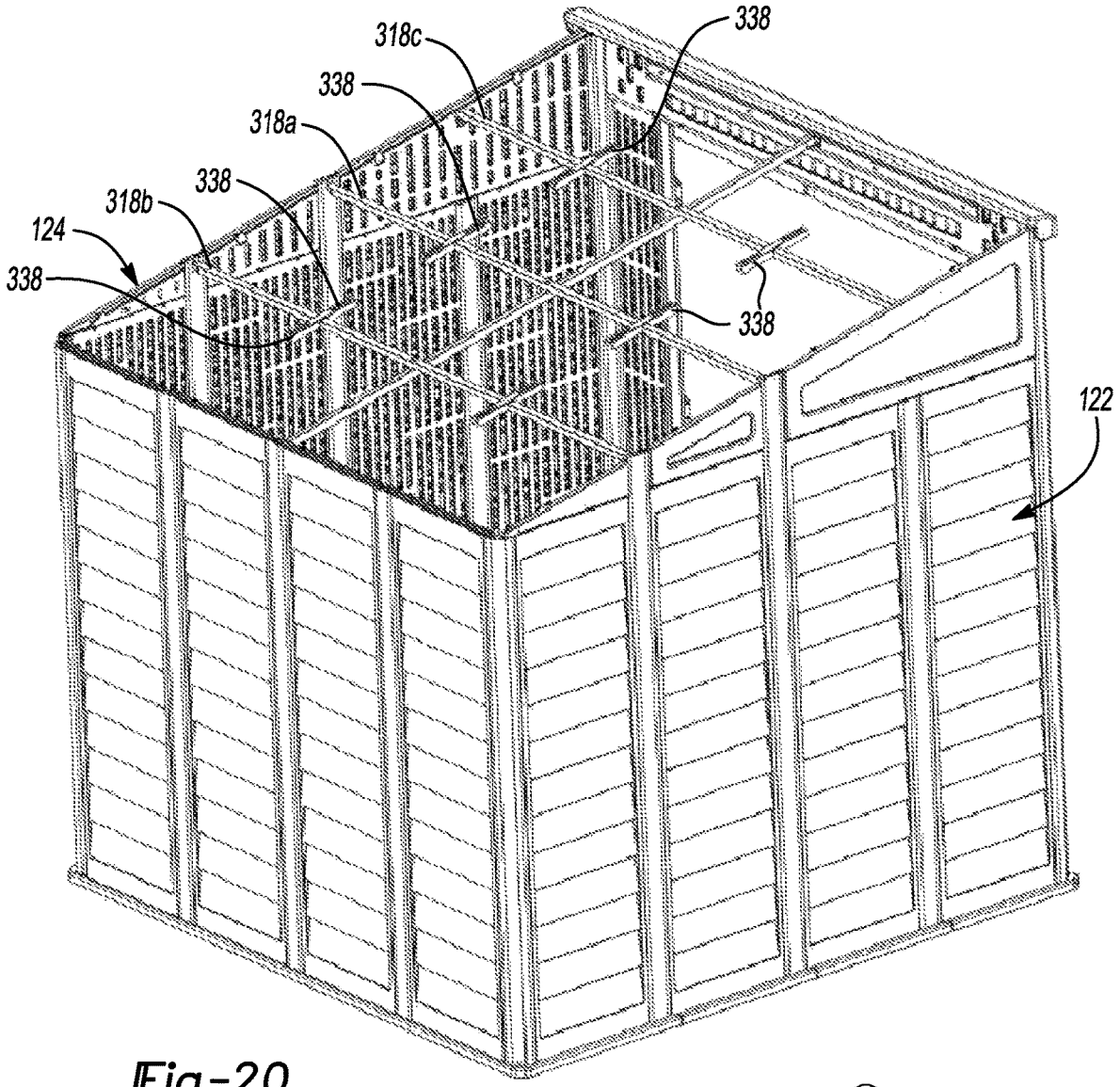
FIG. 20 illustrates a rear-perspective view of a tenth partial assembly of the shed assembly shown in FIG. 1.
Figure 21:
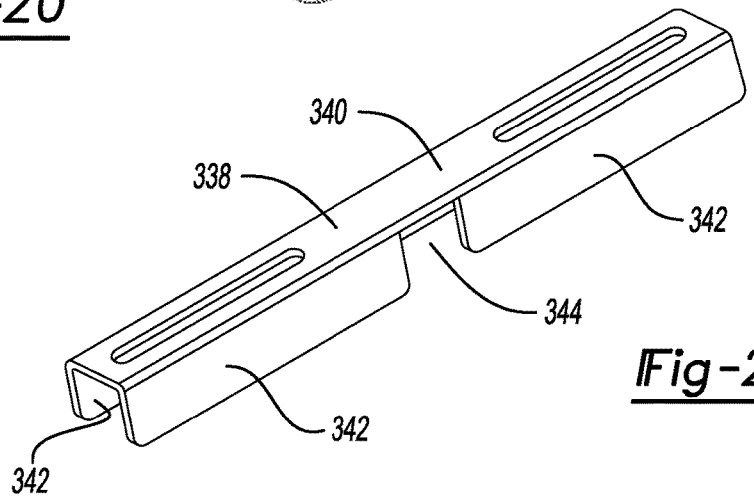
FIG. 21 illustrates a perspective view of an auxiliary roof beam.

FIG. 20 shows attaching of auxiliary roof beams 338 to the first, second, and third lateral roof beams 318*a*, 318*b*, 318*c*. FIG. 21 shows a perspective view of one of the auxiliary roof beams 338. The auxiliary roof beams 338 may be connected to the lateral roof beams 318*a*, 318*b*, 318*c*, and cooperate with the longitudinal roof beam 288 to support one or more roof panels of the roof assembly 128. The auxiliary roof beams 338 may include a base 340 and one or more legs 342 extending from the base 340. The legs 342 may be spaced apart from one another to form a notch 344, and an inner periphery of the notch 344 may lie along and engage one of the lateral roof beams 318*a*, 318*b*, 318*c*.

Figure 22:
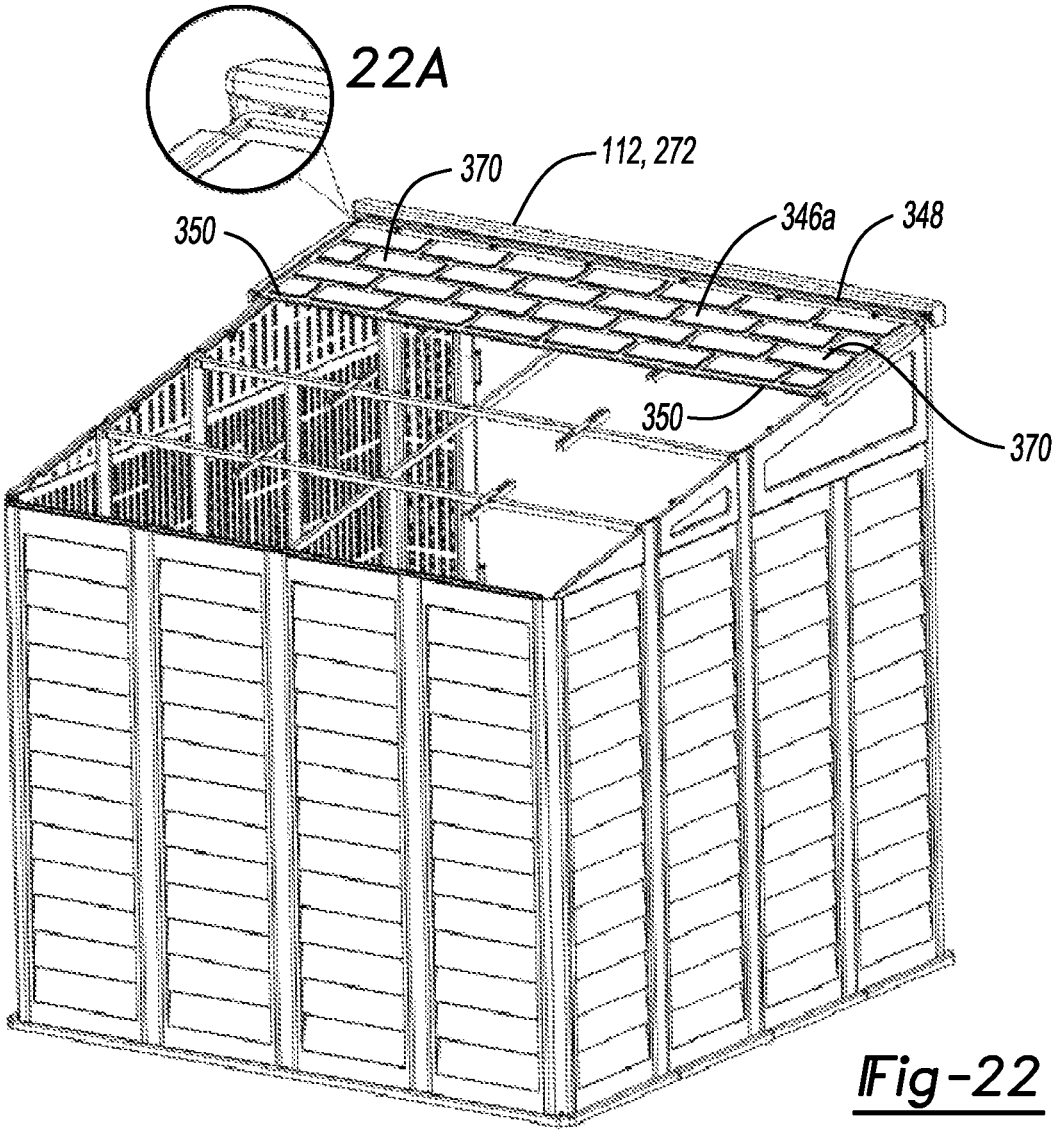
FIG. 22 illustrates a rear-perspective view of a partial assembly of the shed assembly shown in FIG. 1.
Figure 22A:
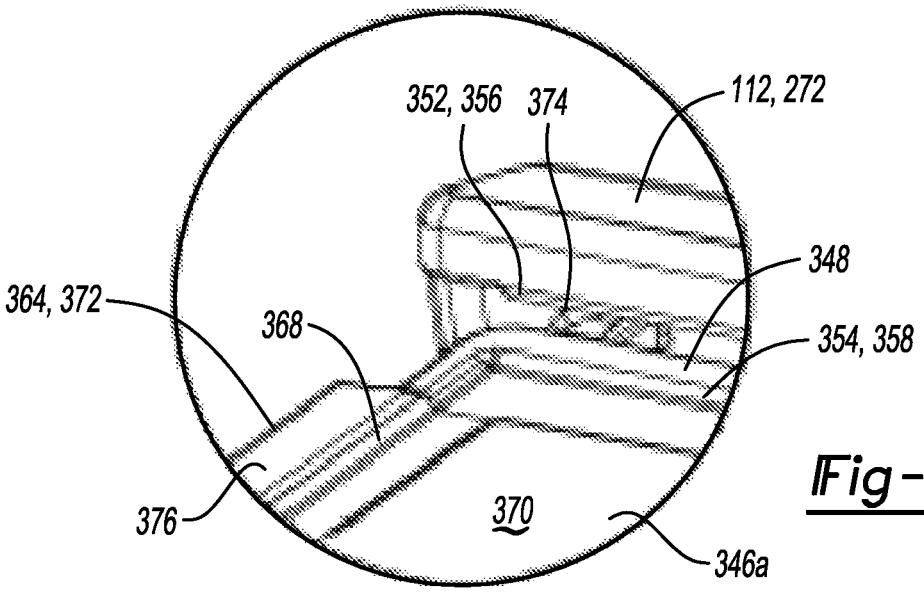
FIG. 22A illustrates a detail view taken along lines 22-A in FIG. 22.
Figure 23:
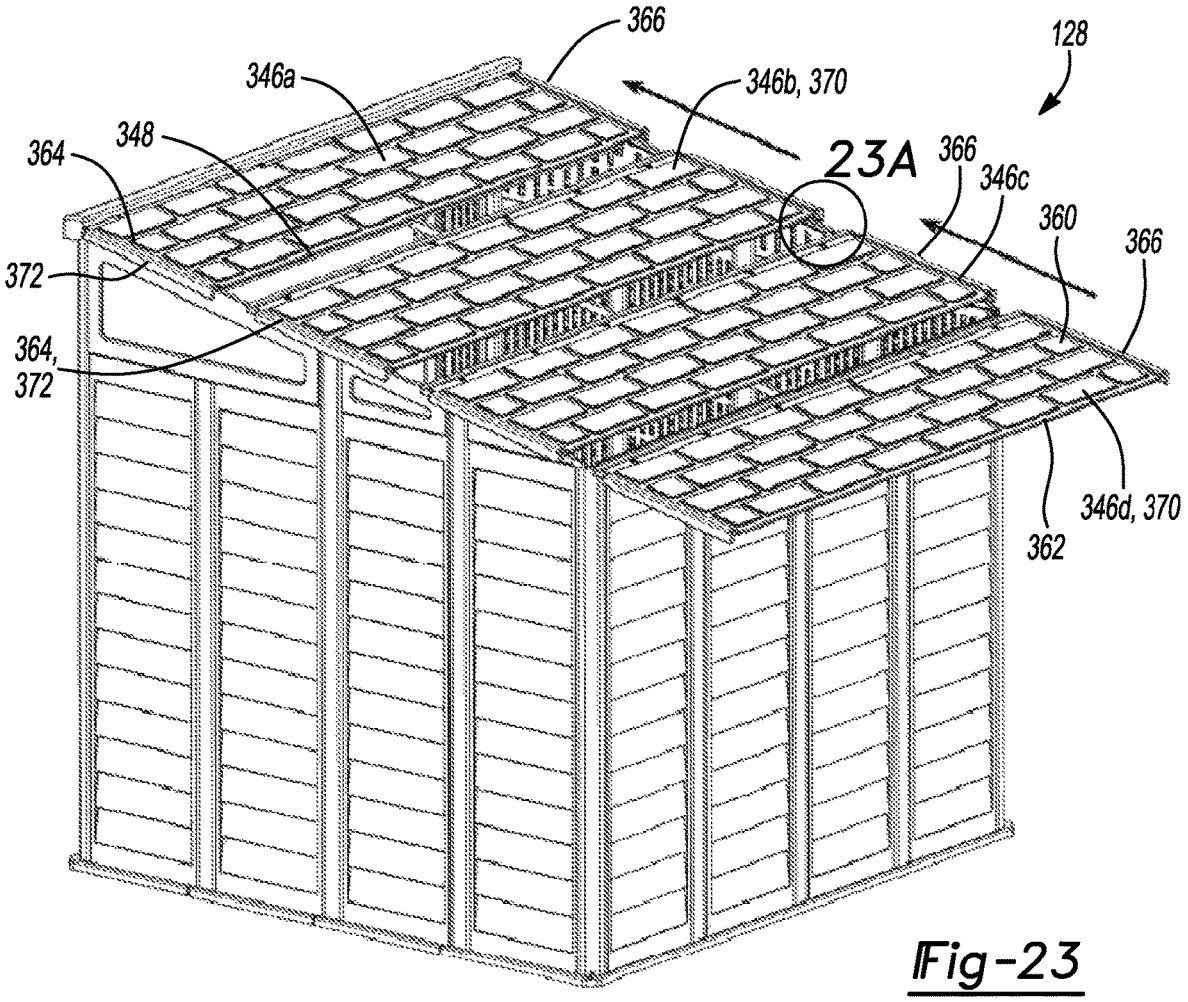
FIG. 23 illustrates a rear perspective view of a partial assembly of the shed assembly shown in FIG. 1.
Figure 23A:
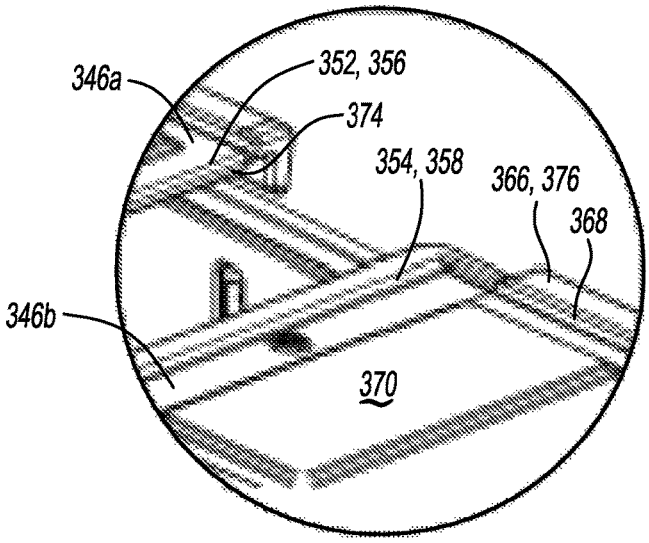
FIG. 23A illustrates a detail view taken along lines 23-A in FIG. 23.

FIG. 22 shows assembling of a first blow-molded roof panel 346*a* to the blow-molded header 112 and FIG. 22A shows a detail view taken along the lines 22-A in FIG. 22. FIG. 23 shows assembling of a second blow-molded roof panel 346*b*, a third blow-molded roof panel 346*c*, and a fourth blow-molded roof panel 346*d*, to form the roof assembly 128. FIG. 23A shows a detail view taken along the lines 23-A in FIG. 23.

Each of the blow-molded roof panels 346*a*-346*d* include a number of regions, such as a front end region 348, a rear end region 350, a first side region 364, and a second side region 366 and a top surface 360 and a bottom surface 362 that opposes the top surface 360. The top surface 360 may include a number of protrusions or raised features that may resemble shingles 370. The bottom surface 362 may engage or lie on top of the base 340 of each of the auxiliary roof beams 338 (FIG. 20) to sandwich the base 340 between the bottom surface 362 and the lateral roof beams 318*a*-318*c*.

The blow-molded roof panels 346*a*-346*d* may be substantially identical to one another to optimize tool utilization and economies of scale during manufacture of the shed components.

As described herein, the blow-molded roof panels 346*a*-346*d* may be fixed to one another and the blow-molded header 112 in such a manner to enable easy assembly of the roof assembly 128. The front end region 384 of each of the blow-molded roof panels 346*a*-346*d* may include a first engagement feature 352 (e.g., a groove 356 or tongue 358) that may be configured to engage a second engagement feature 354 (e.g., a groove 356 or tongue 358 of an adjacent component (e.g., another blow-molded roof panel 346 or the blow-molded header 112.

As an example, the first blow-molded roof panel 346*a* includes a tongue 358 disposed in the front end region 354. The tongue 358 of the first blow-molded roof panel 346*a* may be inserted into the groove 356 formed by a protrusion or lip 374 extending from a bottom portion of the top rail 272 of the blow-molded header 112. A rear-end region 350 of the first blow-molded roof panel 346*a* may define another first engagement feature 352 (e.g. another groove 356) that engages another second engagement feature 354 (e.g., another tongue 358) to detachably connects the first blow-molded roof panel 346*a* to the second blow-molded roof panel 346*b*. The second blow-molded roof panel 346*b* may be detachably connected to the third blow-molded roof panel 346*b* and the third blow-molded roof panel 346*c* may be detachably connected to the fourth blow-molded roof panel 346*d* in the manner described above.

As described above, the roof assembly 128 may be angled from the front wall 120 to the rear wall 126 to enable directing precipitation to run off the roof assembly 128 to an area rear of the rear wall 126. The roof assembly 128 may include a number of features to further facilitate routing of water or snow towards an area disposed behind the rear wall 126. As an example, the shingles 370 may be spaced apart from one another to form several grooves to direct precipitation rearward. Additionally or alternatively, the first and second side regions 364, 366 each include a raised portion 376 that may be spaced apart from each of the shingles 370 to form a drip rail 368. The drip rail 368 may extend from the front end portion 348 to the rear end portion 350 to direct precipitation away from and off of the roof assembly 128.

In one or more embodiments, the first side region 364 and the second side region 366 may each include a fascia 372. The fascia may be formed by an elongated body and may be disposed below the drip rail 368. The fascia 372 of each of the blow-molded roof panels 346*a*-346*d* may extend orthogonally with respect to the top surface 360 of each of the blow-molded roof panels 346*a*-346*d* so that the fascia 372 is spaced apart from and covers a portion of the first and second sidewalls 122, 124 to create the overhang 170. The overhang 170 may block or prevent precipitation from entering between the roofline panels 114-116 and the blow-molded roof panels 346*a*-346*d*. Each fascia 370 of the blow-molded roof panels 346*a*-346*d* may taper from the rear edge region 350 to the front edge region 348.

Figure 24:
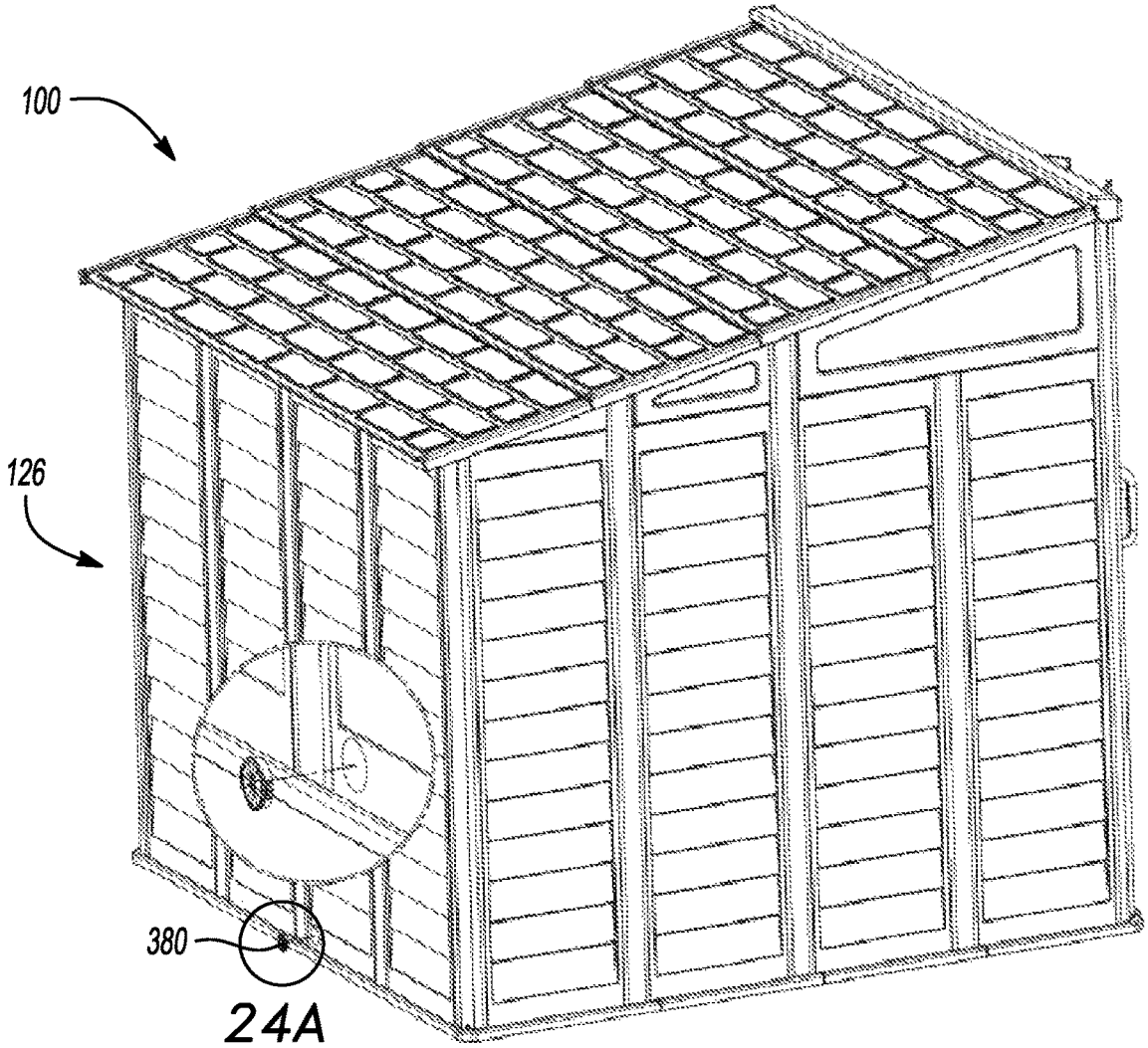
FIG. 24 illustrates a rear perspective view of the shed assembly shown in FIG. 1.
Figure 24A:
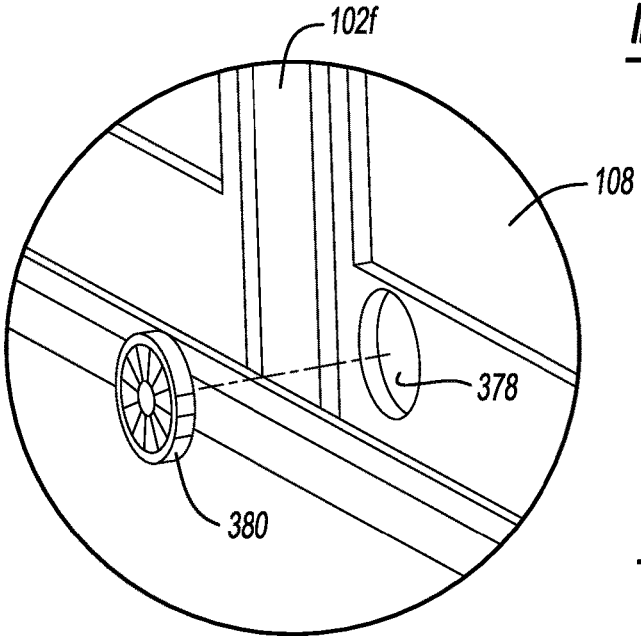
FIG. 24A illustrates a detail view taken along lines 24-A in FIG. 24.

FIG. 24 shows assembly of a ventilation member to the rear wall 126 of the four-panel storage shed 100 and FIG. 24A shows a detail view taken along the lines 24-A in FIG. 24. In one or more embodiments, one or more of the walls 120-126 may include one or more vents 380 configured to expel liquid (e.g., water) disposed within the shed 100. Alternatively or additionally, the vent 380 may be configured to permit a flow of fresh air into the interior of the shed. One or more of the blow-molded wall panels 108 (e.g., one disposed adjacent to the sixth extruded wall upright 102*f*) may define a ventilation aperture or opening 379 that receives the vent 380.

Blow-molding is a manufacturing process by which hollow plastic parts are formed. The blow-molding process typically begins with a hollow tube of molten plastic, which is commonly referred to as a parison. The parison is clamped into a mold and air is blown into the parison. The air pressure pushes the plastic into the faces of the mold so that the plastic takes the shapes of the mold. Once the plastic has cooled, the mold may be opened and the part may be ejected from the mold.

In greater detail, conventional blow-molding machines include a mold with two halves and the blow-molding process is initiated with the two mold halves spaced apart. The parison or tube of plastic is extruded between the mold halves and then the mold halves are moved horizontally toward one another. The parison, which is disposed within the mold, is inflated with pressured air, which is typically between about 60 psi and about 150 psi. The parison expands into contact with the inner surface of the molds and the plastic is formed into the desired shape. Thereafter, the air pressure is reduced and the mold halves are separated to allow the blow-molded plastic article to be removed.

The blow-molding process is typically used to create hollow plastic structures such as bottles and containers. The blow-molding process may allow hollow plastic objects to be manufactured economically and in high volume. In addition, the blow-molding process may allow thin-walled objects to be quickly manufactured. Because blow-molded structures include a hollow interior portion and each mold half forms its own wall shape, a variety of different types of structures can be constructed using the blow-molding process.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A floor assembly for use in a storage shed, the floor assembly comprising:

one or more blow-molded floor panels collectively configured to be attached to one another to form a shed floor surface, a first floor panel of the one or more blow-molded floor panels including a main body provided with a top surface and a bottom surface, wherein the top surface defines a first anchor aperture, and the first anchor aperture extends through the bottom surface, the bottom surface of the first floor panel defines a first pocket wherein the first pocket is concentric with the anchor aperture, wherein the bottom portion of the one or more anchors includes a base and a boss, and the top portion of the one or more anchors includes a post, wherein the boss is disposed between the base and the post, and wherein in the installed state, the base of the one or more wall anchors nests within the first pocket; and one or more anchors, each anchor provided with a bottom portion and a top portion, the top portion extending from the bottom portion, wherein in an installed state, the bottom portion is disposed between the bottom surface and the top surface, and the top portion is disposed above the top surface.

2. The floor assembly of claim 1, wherein the first floor panel defines a second pocket, wherein the second pocket is concentric with at least one of the anchor aperture and the first pocket, and wherein the boss is received the second pocket.

3. The floor assembly of claim 1, wherein the first floor panel includes a raised surface and a lip each extending from the top surface, the lip outwardly spaced apart from the raised surface, the first anchor aperture disposed between the lip and the raised surface.

4. The floor assembly of claim 3, wherein the first floor panel includes a protrusion obliquely extending from the main body, the protrusion forming a door threshold.

5. The floor assembly of claim 3, wherein first floor panel defines a channel, an inner periphery of the channel formed by the raised surface and the lip, the channel configured to receive a wall panel so that a bottom region of the wall panel lies along at least a portion of the inner periphery of the channel.

6. The floor assembly of claim 3, wherein an outer periphery of the raised surface defines a number of notches including a first notch, the first notch configured to receive a protrusion extending from an inner surface of a wall panel of the storage shed.

* * * * *